United States Patent [19]

Uchiyama et al.

[11] Patent Number: 4,568,625

[45] Date of Patent: Feb. 4, 1986

[54] DEVELOPER COMPRISING A MODIFIED SILICONE OIL AND DEVELOPMENT PROCESS FOR ELECTROPHOTOGRAPHY

[75] Inventors: Masaki Uchiyama, Tokyo; Yasuo Mitsuhashi, Yokohama; Kazunori Murakawa, Tokyo; Masanori Takenouchi, Urawa; Eiichi Imai, Narashino; Koushi Suematsu, Kawasaki, all of Japan

[73] Assignee: Canon Kabushiki Kaisha, Tokyo, Japan

[21] Appl. No.: 603,429

[22] Filed: Apr. 24, 1984

[30] Foreign Application Priority Data

| | | | |
|---|---|---|---|
| Apr. 25, 1983 | [JP] | Japan | 58-72432 |
| Apr. 25, 1983 | [JP] | Japan | 58-74554 |
| Apr. 27, 1983 | [JP] | Japan | 58-74555 |
| Apr. 27, 1983 | [JP] | Japan | 58-74556 |
| Apr. 27, 1983 | [JP] | Japan | 58-74557 |
| Apr. 27, 1983 | [JP] | Japan | 58-74559 |
| Apr. 28, 1983 | [JP] | Japan | 58-74848 |

[51] Int. Cl.[4] ..... G03G 9/08

[52] U.S. Cl. ..... 430/110; 430/120; 430/122

[58] Field of Search ..... 430/110, 106.6, 99, 430/122, 120

[56] References Cited

U.S. PATENT DOCUMENTS

| | | | |
|---|---|---|---|
| 4,397,941 | 8/1983 | Fickes | 430/110 |
| 4,430,409 | 2/1984 | Matsumoto et al. | 430/106.6 |

*Primary Examiner*—John L. Goodrow

*Attorney, Agent, or Firm*—Fitzpatrick, Cella, Harper & Scinto

[57] ABSTRACT

A developer contains a silicone oil which has an amine on side chain thereof, a development process comprises arranging a member holding an electrostatic image on the surface and a member for carrying a toner on the surface and a fixing method comprises contacting a toner image on an image-supporting member with a heated roller, said toner image being formed of a toner which contains a silicone oil having an amine on side chain thereof and has an MI of 0.01–10 g/10 min.

17 Claims, 6 Drawing Figures

DEVELOPER COMPRISING A MODIFIED SILICONE OIL AND DEVELOPMENT PROCESS FOR ELECTROPHOTOGRAPHY

BACKGROUND OF THE INVENTION

1. Field of the Invention

The present invention relates to a developer and a development process for visualizing latent images in electrophotographic recording, electrostatic printing, magnetic recording, etc. More particularly, the invention relates to a developer which, in direct or indirect development processes for electrophotography, is positive-chargeable uniformly and strongly, and visualizes negative-electrostatic latent images to high quality images, and to a development process employing this developer.

2. Description of the Prior Art

A number of electrophotographic processes are known as disclosed in U.S. Pat. No. 2,297,691, Japanese Pat. Pub. No. 23910/67 (corresponding to U.S. Pat. No. 3,666,363), Japanese Pat. Pub. No. 24748/68 (corresponding to U.S. Pat. No. 4,071,361), and so forth. Electrophotographic processes generally comprise forming electrostatic latent images on photoconductor-containing photosensitive members by various methods, developing these latent images with developer powders (hereinafter referred to as toners), and if necessary, transferring toner images onto transfer media such as paper and fixing the resulting images with heat, pressure, or solvent vapors. When the process includes the transfer step, an additional step is necessary for removing the toner remaining on the photosensitive member after this transfer step.

A variety of development techniques are known including, for example, the magnetic brush process as disclosed in U.S. Pat. No. 2,874,063, the cascade process as disclosed in U.S. Pat. No. 2,618,552, the powder cloud process as disclosed in U.S. Pat. No. 2,221,776, the process employing a conductive magnetic toner as disclosed in U.S. Pat. No. 3,909,258, the process employing a high resistance magnetic toner as disclosed in Japanese Pat. Appl. Kokai No. 31,136/78, the process as disclosed in Japanese Pat. Appl. Kokai Nos. 42,121/79, 18,658/80, and 43,027/79, the fur brush process, the "touchdown" process, and the impression process.

The electronic printing process utilizing these techniques, as proposed in Japanese Pat. Pub. No. 14,342/67 and other literature, is a printing method in which an electrically charged toner is conducted onto a recording medium by utilizing electric fields and is fixed.

The electrostatic recording process comprises forming an electrostatic latent image on a dielectric layer, applying an electrically charged toner powder to adhere thereto, and fixed the toner image. Similarly the magnetic recording process comprises forming a magnetic latent image on a recording medium, developing the image with a toner containing a magnetic material, and transferring and fixing the toner image on a transfer medium.

Toners hitherto used for the above cited development processes are fine powders of natural or synthetic resins in which dyes or pigments are dispersed. An example of these toners is a fine powder of particle sizes 1−30 μm prepared by pulverizing a dispersion of a colorant in a binder resin such as polystyrene and the like. Magnetic toners hitherto used are powders similar to the above but containing particles of a magnetic material such as magnetite and the like.

The development proceeses are roughly classified into the dry development process and the wet development process. The former is further divided into the process employing a two-component developer that comprises a toner and a carrier and the process employing a one-component developer that contains no carrier In the two-component developer, toner particles are usually glass beads, which are used in mixture with carrier particles such as powdered iron and the like.

Positive-charge regulators used in the toners for the dry development process include generally quaternary ammonium compounds and organic dyes, particularly basic dyes and salts thereof. Examples of positive-charge regulators generally used are benzyldimethylhexadecylammonium chloride, decyl-trimethylammonium chloride, nigrosine base, nigrosine, safranine γ, crystal violet and the like. In particular, nigrosine base and nigrosine are often used as positive-charge regulators. The positive-charge regulator is usually added to a thermo-plastic resin and dispersed by melting the mixture with heating. The resulting mass is finely pulverized, and if necessary, particle sizes of the powder are arranged in a suitable range. The powder thus obtained is used as a toner. However, dyes used as charge regulators are complicated in structure and have indefinite properties, thus being deficient in the constancy of product quality. Additionally, these dyes are liable to decompose or deteriorate under the influence of hot mixing, mechanical shock, friction, or variations in temperature and humidity conditions. Hence, the charge regulating ability of these dyes often lowers.

Accordingly, when a toner containing such a charge regulator is applied to a copying machine for development, the charge regulator may decompose or deteriorate as the number of copying times increases, causing the degradition of the toner.

Moreover, many positive charge regulators are hydrophilic, and hence on account of a poor dispersion of the hydrophilic dye (charge regulator) in a binder resin, bare particles of the dye will appear on surfaces of toner particles during crushing or grinding after melt-mixing of the dye and the binder resin. When such a toner is used under high humidity conditions, no good quality image will be obtained because of the hydrophilicity of the dye.

When such a conventional positive-charge regulator is used in a toner, considerable variation will arise in the electric charge generated the surface of toner particles between the toner particles, between the toner and carrier particle, or between the toner particle and the toner-carrying member, such as a sleeve employed. This tends to cause troubles such as fogging, toner scattering, and contamination with carrier particles. These troubles become remarkable when a large number of copies are made continuously. Thus such toners are substantially unsuited to copying machines.

Further, under high humidity conditions, many toners containing the conventional positive-charge regulator do not stand for use since the transferring efficiency of toner image lowers markedly. Even under normal temperature and humidity conditions, these toners, when stored for a long time, often deteriorate and become unusable, on account of the unstability of the positive-charge regulator.

Japanese Pat. Pub. No. 22,447/78 has proposed a method for preparing a positive-charge regulative developer, which comprises incorporating a powder of an aminosilane-treated metal oxide in a developer. The present inventors minutely investigated this method. That is, developers were prepared according to examples described in the specification of said patent, by using metal oxides, e.g. colloidal silica, alumina, titanium dioxide, zinc oxide, iron oxide, γ-ferrite, and magnesium oxide, which had been treated with various aminosilane. However, any of these preparation experiments did not give a developer exhibiting satisfactory characteristics for practical use. These developers have proved to have several drawbacks.

That is, most of the developers cannot retain favorable characteristics for high fidelity development of latent images. Although exhibiting desirable functions at first, these developers lose initial characteristics during long term continuous survice, becoming unfit for use. That is, they cause fogging and when reproducing a linear pattern, they scatter and form spots in the neighborhood of the edges. Additionally they form lower density images. Other drawbacks of these developers are that, in development and transfer under high temperature and humidity environmental conditions, they result in lowered image density, the toner scattering around a linear pattern image, fogging, and toner-undeposited sites in image areas.

Most of these charge regulators are colored. Such being the case, these charge regulators are difficult to use in positive-chargeable color toners.

On the other hand, the following processes are known for the development by use of one-component nonmagnetic toners.

One development process employs a development system comprising a movable developer-carrying means for carrying a developer and supplying it to a latent-image-holding member, a developer-supplying means, and a movable coating means which serves to receive the developer from the developer-supplying means and to apply the developer onto the movable developer-carrying member. The movable coating means has a fiber brush for holding the developer on the surface, faces the movable developer-carrying means, and moves in the same direction at the facing position as does the movable developer-carrying means and at a higher speed than the movable developer-carrying means. In this process, the developer is uniformly applied with the movable coating means on the movable developer-carrying means, and the coating layer is allowed to approach to an electrostatic latent image area on the latent-image-holding member, thereby developing the latent image.

Another development process employs a development system comprising (i) a rotatable magnetic roller for forming a magnetic brush by absorbing a magnetic carrier which has been mixed with a one-component nonmagnetic toner for the purpose of charging particles of the toner, and (ii) a development roller for taking toner particles from the magnetic roller and for developing an electrostatic image on an electrostatic-image-holding member. The development is carried by keeping the gap between the electrostatic-image-holding member and the development roller at a value larger than the thickness of the toner layer held on the development layer.

Another development process is a method of developing an electrostatic image on an electrostatic-image-holding member by opposing a developer holding member, which holds a developer on the surface, to the electrostatic-image holding member, wherein the developer in a developer-storing means positioned under the developer-holding member is drawn up onto the developer-holding member while vibrating the developer present in the drawing-up portion to activate this developer, whereby a developer layer having a prescribed thickness is formed on the developer-holding member and served for the development.

However, in these process in which the development is conducted by carrying an insulating nonmagnetic toner on a toner-carrying member by the action of nonmagnetic force in the development section, electrostatic attractive force or physical adhesive force is dominant in the development region as the force to retain the nonmagnetic toner on the toner-carrying member. In this respect these processes involve various disadvantage as compared with the development process employing a conventional insulating magnetic toner wherein the toner is retained on a carrying member by the action of magnetic force and electrostatic attractive force. For instance, many toners fail to form a relatively thin, uniform layer on the carrying member. Further, for instance, a toner adheres to the non-image area, that is, so-called background fogging occurs, whereas the toner coating layer on the carrying member is relatively uniform. The amount of the toner adhering to the image area is deficient and consequently the image density is low, whereas the toner coating layer is thin and uniform. Whereas many toners can form a thin uniform coating layer, the formed image is low in fidelity and very poor in resolution. Many toners, during repeated use, result in the reduction of image density and the deterioration of image quality. Under various environmental conditions such as high temperature and humidity conditions and low temperature and humidity conditions, many toners result in the reduction of image density in some cases and fog in some other cases. One-component magnetic toners contain large amounts of a magnetic powder and are therefore expensive as compared with nonmagnetic toners. Additionally it is difficult to form bright color images in the development process employing one-component magnetic toners In recent years various techniques and devices are developed relating to the stage of fixing toner images on paper or the like in image-forming instruments such as electrophotographic copying machines The most common fixing technique today is the so-called heat roll fixing technique wherein an image-receiving sheet bearing a toner is brought into contact with a heated roll to fix the toner image. However, when such a fixing technique is applied, trouble such as so-called "offset" tend to occur. The "offset" herein means the undesirable phenomenon that the toner image held on an image-receiving sheet are partially transferred onto the roller surface. This is a significant problem in the development of the heat roller fixing technique. In the heat roll fixing device generally used today, at least the surface layer of the roller which contacts with toner images is formed usually of silicon rubber or fluororesin, which have good mold releasing properties. But, in many systems, an oil having a mold releasing property such as silicone oil is applied on the silicon rubber or fluororesin surface for the purpose of preventing the offset on the surface and the fatigue of the roller surface. However, the oiling method has problems such that the addition of an oiling system complicates the fixing device and the oil vapor makes operators disagreeable. Accordingly, the approach to the prevention of offset by oiling is undesirable. It is rather desired to develop a toner which is fixable over a wide range of temperature and has a good anti-offset property. It is surely unsuitable in view of the design of a fixing system to demand excess mold-releasing properties of roll materials and lubricant oils the kinds of which are limited, in the development of the heat roll fixing technique. It is rather important for obtaining a compact, inexpensive fixing device to develop an offset-free toner while keeping the balance between the offset-free property and the development property.

The viscosity and the non-adhesiveness have so far been regarded as a point for the purpose of developing an offset free toner. It is important to design the toner composition so that the toner in the molten state will show a small viscosity change with temperature and have a suitable viscosity and further the toner will have low roll-adhesiveness. These, in a few words, are problems on thermal and physical properties of toners. However, the present inventors found out a phenomenon which cannot be explained merely from thermal and physical properties of toners, in the following experiments.

A toner was prepared by compounding 100 parts by weight of a styrene-butyl methacrylate copolymer, 10 parts by weight of low molecular weight polypropylene, and 6 parts by weight of a carbon black. This toner was mixed with a carrier iron powder to make up a negative-chargeable toner. A positive latent image was developed with this toner and transferred onto a plain paper. The unfixed image obtained is designated as N. The same toner (before mixing with the carrier) was mixed with a surface-coated carrier iron powder to make up a positive-chargeable toner. A negative latent image was developed with this toner and transferred onto a plain paper. The unfixed image obtained is designated as P. Then, fixing tests of the images N and P were conducted by using a fixing device which comprised a polytetrafluoroethylene-coated fixing roller containing a halogen lamp therein and a pressure roller coated with silicone rubber. The results were as follows:

TABLE 1

| Surface temp. (°C.) of fixing roller | | 150 | 160 | 170 | 180 | 190 | 200 |
|---|---|---|---|---|---|---|---|
| Image N | A | o | o | o | o | o | o |
| | B | o | o | o | o | o | o |
| Image P | A | x | Δ | Δ | o | o | o |
| | B | x | x | x | Δ | o | o |

Notes
A: Fixability
B: Resistance to offset
o: good
Δ: slightly good
x: poor

The same plain paper as used in the fixing tests had positive charge on passing through the fixing device, where the pair of rollers was negatively charged vs. the paper.

From this fact in view of the results above, the results of the fixing tests may be explained as follows: Since the paper will have positive charge at the time of fixing, electric force acts on the toner of the image to separate it from the paper and transfer to the roll when the toner is positively charged; thus the toner becomes difficult to attach on the paper and easy to result in the offset. On the contrary, the toner when charged negatively becomes easy to attach on the paper and difficult to result in the offset. In consequence, the image N is excellent in fixability and resistance to the offset, while the image P is inferior in fixability and resistance to the offset in spite of being formed of the same toner (except that the carrier is surface-treated). It should be noted that the image P is inferior in ressitance to the offset at lower temperatures (150°-170° C.). When the temperature of the fixing roller is high (190°-200° C.), the toner is sufficiently fused to adhere the paper and conceivably this eliminates the effect of electric force substantially.

SUMMARY OF THE INVENTION

An object of the first aspect of the present invention is to provide a positive-chargeable developer.

Another object of the first aspect of the invention is to provide a stable developer which, during long-term continuous service, maintains initial properties, not resulting in agglomeration of toner particles or variation in charge bearing characteristics.

Another object of the first aspect of the invention is to provide a developer which reproduces images of steady quality without being affected by variation in temperature and humidity, in particular a developer which functions effectively in transfer without resulting in "scattering" (spots of scattered toner deposition on background areas) or "voids" (lack of toner deposition on image areas).

Further object of the first aspect of the invention is to provide a developer which is excellent in storage stability, retaining initial properties after long-term storage.

Still further object of the first aspect of the invention is to provide a colorless charge regulator for positive-chargeable color toners.

According to the first aspect of the present invention there is provided a developer which contains a silicone oil having an amine on side chain thereof.

An object of the second aspect of the present invention is to provide a novel development process which overcomes the foregoing drawbacks.

Another object of the second aspect of the invention is to provide a development process for forming images of high fidelity, steady quality, additionally uniform and sufficient density, and high resolution, without causing background fogging.

Still another object of the second aspect of the invention is to provide a development process which gives good quality images for a long time, particularly in continuous operation.

Further object of the second aspect of the invention is to provide a development process which permits steady operation without being affected by environmental conditions, particularly by high temperature and humidity conditions or low temperature and humidity conditions.

Still further object of the second aspect of the invention is to provide a development process which gives clear-color images.

According to the second aspect of the present invention there is provided a development process which comprises arranging a member holding an electrostatic image on the surface and a member for carrying a toner on the surface to face each other with a definite gap being kept therebetween at a development section; applying a toner containing a silicone oil having an amine on side chain thereof, on the toner-carrying member to a thickness less than said gap; and transferring the applied toner onto the electrostatic image holding member at the development section, thereby developing the image.

An object of the third aspect of the present invention is to provide a fixing method employing heat rolls which gives good fixed images, scarcely causes "offset", and permits a long-term continuous operation.

According to the third aspect of the present invention there is provided a fixing method which comprise contacting a toner image on an image-supporting member with a heated roller, said toner image being formed of a toner which contains a silicone oil having an amine on its side chain and has a melt index (hereinafter abbreviated as MI) of 0.01–10 g/10 min. As used herein, the term "melt index" (MI) refers to the number of grams of thermoplastic resin at 190° C. that can be forced through a 0.0825-inch (2.0955 millimeter) orifice in 10 minutes by a 2160 - gram force.

BRIEF DESCRIPTION OF THE DRAWINGS

1: Electrostatic-image-holding member
2: Toner-carrying member
4: Coating means
5: Toner
6: Power source for bias

DETAILED DESCRIPTION OF THE PREFERRED EMBODIMENTS

Figure 1:
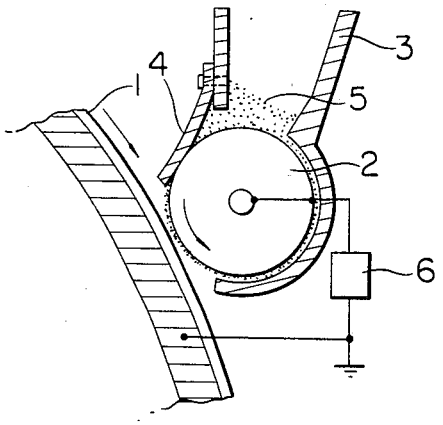
FIGS. 1–5 illustrate embodiments of the development process of the present invention wherein an insulating nonmagnetic toner is used. In the drawings, numbers mean the following.

The invention is characterized in the first place by a developer containing a silicone oil which has an amine on its side chain.

Silicone oils having a constituent represented by the following general formula (I) can be used as the silicone oil having an amine on its side chain.

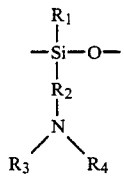

(I)

In the formula, each of $R_1$, $R_2$, $R_3$, and $R_4$ may be any possible radical that does not impair the chargeability of the toner, but is preferred to be as follows: $R_1$ represents hydrogen, alkyl, aryl, or alkoxy; $R_2$ represents alkylene and/or phenylene; and $R_3$ and $R_4$ represent each hydrogen, alkyl, or aryl, wherein the alkyls, aryls, alkylene, and phenylene each may have an amine and, if desired, a substitutent such as halogen provided that the substitutent does not impair the chargeability of the toner.

Commercially available silicone oils having an amine on side chain thereof (hereinafter the silicone oil of said structure is referred to as a modified silicone oil) include, for example, those, which are preferable, represented by the formula

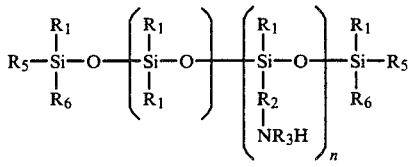

wherein; $R_1$ represents alkyl or aryl; $R_2$ represents alkylene, phenylene, or amine-containing alkylene; $R_3$ represents hydrogen, alkyl, or aryl; $R_5$ and $R_6$ represent each alkyl, aryl, or hydroxyl; and m and n are each a number of 1 or larger. Individual examples thereof are shown in the following table. There can be used alone or in combination.

| | Trade name (maker) | Viscosity at 25° C. (cps) | Amine equivalent |
|---|---|---|---|
| SF8417 | (Toray Silicone Co., Ltd.) | 1200 | 3500 |
| KF393 | (Shinetsu Chem. Co., Ltd.) | 60 | 360 |
| KF857 | " | 70 | 830 |
| KF859 | " | 60 | 22500 |
| KF860 | " | 250 | 7600 |
| KF861 | " | 3500 | 2000 |
| KF862 | " | 750 | 1900 |
| KF864 | " | 1700 | 3800 |
| KF865 | " | 90 | 4400 |
| KF369 | " | 20 | 320 |
| KF383 | " | 20 | 320 |
| X-22-3680 | " | 90 | 8800 |
| X-22-380D | " | 2300 | 3800 |
| X-22-3801C | " | 3500 | 3800 |
| X-22-3810B | " | 1300 | 1700 |

The amine equivalent in the above table is defined as the molecular weight of the silicone oil per one amine group, that is, the value (molecular weight of silicone oil/number of amine groups). Amine equivalents of up to 25,000 are preferable and those of up to 5000 are particularly preferable according to the present invention.

Modified silicone oils used in the invention, since colorless or translucent, give positive-chargeable developers of very clear color. Additionally these modified silicone oils are stable, that is, these have heat-resistant temperatures of about 300° C. These are scarcely decomposed or deteriorated with heat or mechanical shocks, do not have drawbacks such as the deterioration of the charge regulating property, and markedly reduce the degradation of toners during repetitive use of toners when incorporated therein. Moreover, these modified silicone oils have powerful positive-chargeability and high himidity stability, so that toners containing them have good positive chargeability and give clear images, also under high humidity conditions.

In the invention, the modified silicone oil may be either contained in toner particles or deposited on the surface of toner particles. Suitable amounts of the modified silicone oil in the toner are 0.01–30%, particularly 0.02–10%, by weight.

A magnetic powder can be incorporated into the toner containing the modified silicone oil, for the purpose of using the toner as a magnetic toner. Such magnetic powders used are made of materials magnetizable in magnetic fields, including powders of ferromagnetic metals such as iron, cobalt, nickel and the like, and powders of alloys or compounds such as magnetite, γ-iron oxide, ferrite and the like. Suitable contents of such a magnetic powder in the toner are 15–70% by weight.

If necessary, the toner is mixed with carrier particles such as iron powder, glass beads, nickel powder, ferrite powder or the like, and then used as a developer for developing electrostatic images.

The present inventors obtained high fidelity, steady quality images free from background fogging, of uniform and sufficient density, and high resolution by using such a toner containing said modified silicone oil in the following way: A member holding an electrostatic image on its surface and a member carrying the toner on its surface are arranged to face each other with a definete space being kept therebetween at the development section of the former member, the thickness of the toner layer on the toner-carrying member is controlled to be less than said space, and the toner is transferred onto the electrostatic-image holding member at the development section to develop the image.

This development process permits steady long-lasting operation under varying environmental conditions.

As a result of extensive studies of development processes employing known nonmagnetic toners, the present inventors found that, in order to overcome the drawbacks of the prior art process, it is necessary that the electrostatic charge which the toner on the toner-carrying member posses is controlled more precisely than in the development process employing a magnetic toner. For instance, if the charge is less than a certain limit, the toner coating on the toner-carrying member becomes non-uniform and therefore uniform development is impossible. Even if the toner coating is made uniform by increasing the charge, the background fogging is liable to result when this charge is inappropriate. If the charge is too excess, the electrostatic attraction between the toner and the toner-carrying is too strong and hinders the transfer of the toner to the electrostatic image holding member, thus causing decrease in the image density and the formation of inferior quality images. Moreover, in these development processes, the variation of the electric charge on the toner has very significant influence on the image for the above reason during repeated use of the toner or when environmental conditions vary. Accordingly, it is extremely important to secure the stability of the electrostatic charge. In these development processes, the physical adherent force between the toner and the toner-carrying member has clearly influences on the transfer of the toner from the toner-carrying member. For instance, a low degree of freedom of toner particles and a high packing density of toner particles in the toner layer on the toner-carrying result in inferior quality images of low image density and low resolution. Thus, it is also very importnat to prevent the increase in the above physical adherent force. The present inventors reached the conclusion that properties of the toner must be ameliorated in order to solve the above found problems.

Thus, the above noted requisites characteristic of the development process comprising carrying a toner on a toner-carrying member by the action of nonmagnetic force have fulfilled with a toner containing the above stated specific silicone oil.

When an inorganic fine powder is incorporated in the developer of the invention, it is desirable to use an inorganic fine powder which is scarcely soluble in water and stable up to 300° C. and has particle sizes of 10 μm and less, preferably 1 μm and less, or has a specific surface area (BET method, $N_2$ adsorption) of 0.5–400 $m^2/g$. Examples of such inorganic fine powders are colloidal silica and fine powders of alumina, titanium dioxide, barium titanate, magnesium titanate, calcium titanate, strontium titanate, zinc oxide, silica sand, clay, mica, wollastonite, diatomaceous earth, various inorganic oxide pigments, chromium oxide, cerium oxide, iron oxide red, iron oxide, magnetite sand; ferrites such as γ-ferrite, barium ferrite, strontium ferrite, rare earth ferrite, and the like; antimony trioxide, magnesium oxide, zirconium oxide, barium sulfate, barium carbonate, calcium carbonate, and silica.

Both fine powders of silica produced by the dry process and by the wet process may be used in the invention.

In the dry process, herein referred to, a fine silica powder is produced by the vapor phase oxidation of a silicon halide, for instance, by utilizing the thermal decomposition-oxidation reaction of silicon tetrachloride vapor in oxyhydrogen flame. The fundamental reaction in this case is as follows:

$$SiCl_4+2H_2+O_2 \rightarrow SiO_2+4HCl$$

In this production process, fine powders of complexes of silica and other metal oxides can be produced by using a silicon halide and halides of other metals, e.g. aluminum chloride, titanium chloride and the like. Fine powders of these complexes are also included in the scope of the invention.

Commerical fine powders of silica usable in the invention, produced by the vapor phase oxidation of silicon halides are available, for example, under following tradenames:

| | |
|---|---|
| Aerosil | 130 |
| (Japan Aerosil Co., Ltd.) | 200 |
| | 300 |
| | 380 |
| | OX50 |
| | TT600 |
| | MOX80 |
| | MOX170 |
| | COK84 |
| Ca-O-Sil | M-5 |
| (Cabot Co.) | MS-7 |
| | MS-75 |
| | HS-5 |
| | EH-5 |
| Wacker HDK N20 | V15 |
| (Wacker-Chemie GMBH) | N 20E |
| | T 30 |
| | T 40 |
| D-C Fine Silica | |
| (Dow Corning Corp) | |
| Fransil | |
| (Fransil Co.) | |

On the other hand, when the fine powder of silica used in the invention is produced in the wet process, various processes hitherto known are applicable. For instance, the process utilizing the decomposition of sodium silicate with an acid, the decomposition being represented by the general equation (the overall reaction equations for the following processes are omitted).

$$Na_2O.XSiO_2+HCl+H_2O \rightarrow SiO_2.nH_2O+NaCl,$$

the process of the decomposition of sodium silcate with an ammonium or alkali salt, the process of the acid decomposition of an alkaline earth metal silate formed from sodium silicate, the process of forming silica from a sodium silicate solution with an ion exchange resin, and the process of utilizing natural silica or silicate.

Besides anhydrous silicon dioxide (silica), other silicates can also be used in the invention for the fine powder of silica. Such silcates include aluminum silcate, sodium silicate, potassium silicate, magnesium silicate, and zinc silicate.

Commercially fine powders of silica produced by the wet process are available, for example, under following tradenames.

| Tradename | Maker |
|---|---|
| Carplex | Shionogi & Co., Ltd. |
| Nipsil | Niphon Silica Co., Ltd. |
| Tokusil, Fine Sil | Tokuyama Soda Co., Ltd. |
| Vitasil | Taki Fertilizer Manufacturing Co., Ltd. |
| Silton, Silnex | Mizusawa Kagaku Co., Ltd. |
| Himezil | Ehime Yakuhin Co., Ltd. |
| Sailoid | Fuji-Davison Co., Ltd. |
| Hi-Sil | Pittsburgh Plate Glass Co. |
| Durosil | Fiillstoff-Gesellschaft |
| Ultrasil | Marquart (Fuellstaff-Gasellschaft Marquart) |
| Manosil | Hardman and Holden |
| Hoesch | Chemische Fabrik Hoesch K-G |
| Sil-Stone | Stoner Rubber Co. |
| Nalco | Nalco Chem. Co. |
| Quso | Philadephia Quartz Co. |
| Santocell | Monsanto Chemical Co. |
| Imsil | Illinois Minerals Co. |
| Calcium Silikat | Chemische Fabrik Hoesch K-G |
| Calsil | Fiillstoff-Gesellschaft Marquart |
| Fortafil | Imperial Chemical Industries Ltd. |
| Microcal | Joseph Crosfield & Sons, Ltd. |
| Manosil | Hardman and Holden |
| Vulkasil | Farbenfabriken Bayer, AG |
| Tufknit | Durham Chemicals Ltd. |
| Starsil | Kamishima Chemical Co., Ltd. |
| Silmos | Shiraishi Kogyo Co., Ltd. |
| Starlex | Kamishima Kagaku Co., Ltd. |
| Frucosil | Taki Fertilizer Manufacturing Co., Ltd. |

Of these fine powders of silica, those having a specific surface area (BET method $N_2$ adsorption) of at least 30 $m^2/g$, particularly 50–400 $m^2/g$, give good results.

It is already known that a fine powder of silica produced by the vapor phase oxidation of a silicone halide is added to a developer. However, the addition of such a fine powder of silica is unsuited, since this changes the positive-chargeability of a developer to negative even when the developer contains a positive charge regulating dye, and the developer visualize negative electrostatic images. The present inventors studied about this phenomenon, and found that conventional fine powders of silica produced by the vapor phase oxidation of silicon halides reduce the charge carried by positive-chargeable developers or reverse the polarity of the charge. As a result of further minute studies for the purpose of obtaining a developer which would have a stable and uniform positive chargeability, the present inventors found that it is effective to incorporate into a developer a fine powder of silica treated with said modified silicone oil.

In the invention the modified silicone oil is used for the treatment in such amounts that the contents thereof in the treated fine powder of silica will be 0.2–70% by weight and the content in the developer will be 0.0001–10% by weight. Further, the proper amount of the modified silicone oil used for the treatment is given by the equation $$\frac{ab}{30000} \leqq X \leqq \frac{b}{2} \qquad \text{(II)}$$

wherein, X is the proper amount (parts by weight) of the silicone oil per 100 parts by weight of the untreated fine powder of silica, b is the specific surface are ($m^2/g$) of the untreated fine powder of silica, and a is the amine equavalent of the modified silicone oil.

When $X > b/2$, the modified silicone oil is in large excess relative to the fine powder of silica and this tends to cause troubles such as the ooze of the silicone oil from the powder. On the other hand, when $X < b/30{,}000$, the chargeability is insufficient and this makes it difficult to achieve the object of the present invention.

The viscosity at 25° C. of the modified silicone oil to be used is desirably up to 5000 cps, preferably up to 3000 cps. When the viscosity exceeds 5000, such a modified silicone oil insufficiently disperse in the fine powder of silica and is liable to cause defects such as fogging.

The treatment of the fine powder of silica with the modified silicone oil can be performed, for instance, as follows: The powder is vigorously stirred and while heating if necessary, sprayed with a solution of the silicone oil or blowed with the vapor thereof. Alternatively, a slurry of the powder is stirred and the silicone oil or a solution thereof is added thereto. Preferably, the treated powder thereafter is heated at a temperature of about 50° to about 400° C.

In the invention, the modified silicone oils listed above can be used alone or in combination.

Effective amounts of the treated fine powder of silica in the developer are 0.01–20% based on the weight of the developer. Particularly, when the amount if 0.03–3%, the developer exhibits a highly stable positive chargeability. Favorable form of the treated fine powder of silica in the developer is that this powder adheres in an amount of 0.01–5% by weight (based on the weight of the developer) to the surface of toner particles.

The fine powder of silica used in the invention, if necessary, is treated previously with a silane coupling agent or for the purpose of improving the hydrophobicity, with some other organic silicone compound. For this treatment, known methods are adaptable.

Suitable treating agents for this purpose are compounds reactive with the fine powder of silica or physically adsorbable thereupon, including, for example, aminoprophyltrimethoxysilane, aminopropyltriethyoxysilane, diethylaminopropyltrimethoxysilane, aminophenyltrimethoxysilane, dimethylaminophenyltriethoxysilane, dimethylsilicone oil, hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoixysilane, diphenyldiethoxysilane, hexamethylsiloxane, 1,3-diphenyltetramethyldisiloxane, 1,3-diphenyltetramethylsiloxane, and dimethylpolysiloxanes which have 2–12 siloxane units per molecule and one hydroxyl linked to each terminal Si atom. These treating agents also can be used alone or in combination, and the like.

The developer containing the fine powder of silica treated with the modified silicone oil, according to the invention, has stable triboelectric chargeability and exhibits uniform positive chargeability under various environmental conditions. Accordingly, the developer when used gives clear, dense, fog-free images, and no degraded image during a long-term continuous survice, and clear images also under high temperature and humidity conditions and low temperature and humidity conditions.

Binder resins for toner usable in the invention are; homopolymers of styrene or substituted styrene, e.g. polystyrene, poly(p-chlorostyrene), and polyvinyltoluene; styrene copolymers, e.g. styrene-p-chlorostyrene, styrene-propylene, styrene-vinyltoluene, styrene-vinylnaphthalene, styrene-methyl acrylate, styrene-ethyl acrylate, styrene-butyl acrylate, styrene-octyl acrylate, styrene-methyl methacrylate, styrene-ethyl methacrylate, styrene-butyl methacrylate, styrene-methyl α-chloromethacrylate, styrene-acrylonitrile, styrene-vinyl methyl ether, styrene-vinyl ethyl ether, styrene-vinyl methyl ketone, styrene-butadiene, styrene-isoprene, styrene-acrylonitrile-indene, and styrene-maleic acid ester copolymers; and other miscellaneous resins, e.g. poly(methyl methacrylate), poly(butyl methacrylate), poly(vinyl chloride), poly(vinyl acetate), polyethylene, polypropylene, polyester, polyurethane, polyamide, poly(vinyl butyral), poly(acrylic acid), rosin, modified rosin, turpentine resin, phenolic resin, aliphatic or alicyclic hydrocarbon resin, aromatic petroleum resin, chlorinate resin, and paraffin wax. These binders can also be used alone or in combination.

The colorant used in the developer of the invention can selected from a wide variety of known dyes and pigments, e.g. carbon black, phthalocyanine blue, indanthrene blue, peacock blue, permanent red, lake red, rhodamine lake, hansa yellow, permanent yellow, and benzidine yellow, and the like.

Among the developers containing the modified silicone oil treated fine powder of silica of the invention, those having a MI of 0.01–10 g/10 min. are suited for the heat fixing method.

The reason for the effectiveness of the toner of the invention in the heat fixing method is considered as follows: As already stated, the offset phenomenon in heat roll fixing relates intimately to the triboelectricity due to the friction between the roll and the unfixed-image supporting medium such as transfer paper. That is, because the transfer paper supporting an unfixed electropositive image is liable to cause the offset when charged positively by the friction with the fixing roll and the pressure roll, the offset can be prevented by a suitable means of giving electropositive charge to the fixing roll or the pressure roll. The toner of the invention contains the silicone oil having an amine on its side chain and this silicone oil is partially transferred onto the fixing roll and the pressure roll. In consequence, this silicone oil, having a strong positive chargeability, reduces the negative chargeability of the fixing roll and the pressure roll relative to the transfer paper or reverse the charging polarity. Thus, the offset is substantially inhibited.

It is a reason for using the silicone oil having an amine on its side chain in the invention that this silicone oil gives a strong positive chargeability highly stable to humidity to the toner. Further, the reason for limiting the MI of the toner within the range of 0.01–10 g/10 min. (preferably 0.05–8 g/10 min) is that the MI range is a requisite for the toner containing the specific silicone oil to posses excellent fixability, anti-offset property, and durability.

The MI in the invention was measured by using an apparatus in accordance with JIS K210 and by hand-cut operation, at 125° C., 10 Kg load, and 5–8 g charge.

The electrophotographic processes for which the toner of the invention is adapted involve, e.g. well-known processes for forming electronegative latent images.

The Carson process which comprises negative charging of an N-type photoconductor such as a zinc oxide photoconductor, organic photoconductor and the like, and image exposure of the photoconductor to form a latent image; and the NP process which comprises negative charging of a three-layer photosensitive member consisting of an insulating layer, a P-type photoconductive layer, and a conductive substrate, image exposing and simultaneous positive charging or AC corona discharging, and blanket exposing on the entire surface, thus forming a latent image.

The processes for developing electronegative latent images involve, e.g. the magnetic brush process as disclosed in U.S. Pat. No. 2,874,063; the cascade process as disclosed in U.S. Pat. No. 2,221,776; the process as disclosed in U.S. Pat. No. 3,909,258 wherein a conductive magnetic toner is employed; the processes disclosed in Japanese Pat. Appl. Kokai Nos. 42121/79, 18656/80, and 43027/79, wherein an insulating magnetic toner is employed; the fur brush process; the powder cloud process; the touchdown process; the impression process; and the process as disclosed in Japanese Pat. Appl. Kokai No. 31136/78, wherein a high resistivity megnetic toner employed.

The heat roll fixing processes involve, e.g. the following process: A fixing roll coated with a fluororesin silicone rubber, or silicone resin, containing a heat source and a pressure roll coated with a fluororesin, silicone rubber, silicone resin, or metal sheet, containing a heat source as required are arranged nearly parallel to each other, and passing an unfixed-image-supporting medium (transfer paper) through the gap between both rolls, where a line pressure of roughly 0.01–10 Kg/cm is applied to the transfer paper to fix the image. This heat roll fixing system is provided, if necessary, with a roller for supplying heat, a cleaner for removing the offset toner, and a means for applying an oil. Further, as occasion demands, this system is combined with a system for transferring a developed image from a latent image holding member to a transfer paper. For this purpose, this system can utilize the corona transfer technique, the bias roll transfer technique or the magnetic transfer technique. In this case, the toner remaining on the latent image holding member is required to clean. For this purpose, the blade cleaning technique, the fur brush cleaning technique or the magnetic brush cleaning technique can be utilized. The electronegative latent image referred to above means a latent image having a negative potential relative to the development electrode, and includes not only images having negative charge but also images having positive charge when the reverse development is conducted.

FIG. 1 illustrates an embodiment of the process for developing electrostatic images with an insulating non-magnetic toner. In the drawing, 1 is a cylindrical electrostatic image holding member. On this member 1 is formed an electrostatic latent image according to a known electrophotographic technique, e.g. the Carson process or the NP process, the insulating nonmagnetic toner 5 in a hopper 3, which is a toner feeding means, is applied on a toner-carrying member 2 while controlling the thickness of the applied toner layer with a spreading means 4, and the latent image is developed with the applied toner 5. The toner-carrying member 2 is a cylindrical development roller made of stainless steel. This development roller can also be made from aluminum or other metal. Further this roll may be a metal which is coated a resin for the purpose of giving desirable triboelectric charge to the toner. The toner spreading means 4 may be a blade as depicted or an elastomer roller. When the spreading means 4 is an elastomer roller, the charge carried by the toner on the toner-carrying member 2 can be controlled by varying the elastomer roller pressure on the toner-carrying member 2. The gap between the electrostatic image holding member 1 and the toner-carrying member 2 is preferably set to larger than the thickness of the applied toner layer on the toner-carrying member 2. Further preferably, a development a bias is applied between the electrostatic image holding member 1 and the toner-carrying member 2, from a bias power source 6.

Figure 2:
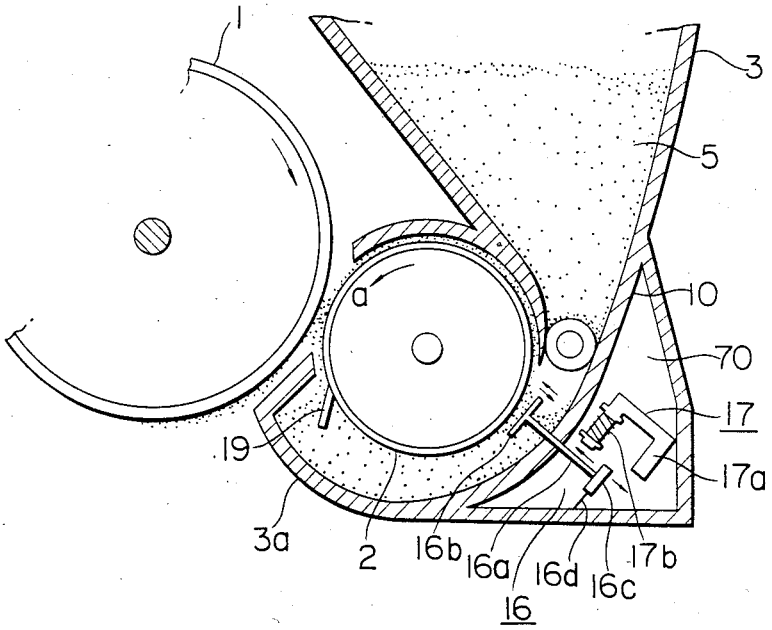

FIG. 2 illustrates another embodiment of the above development process, wherein 1: an electrostatic image holding member, 2: a toner-carrying member, 5: a toner, 3: a hopper, 16: a vibrating member, 17: a vibration generator, 16a: a permanent magnet, 19: a cleaning blade, and 10: a toner-feed member. In this case, a uniform toner coating layer is formed on the toner-carrying member 2 rotating at a constant, by vibrating the vibrating member 16 with a suitable amplitude and frequency, the toner-carrying member 2 is opposed to the electrostatic image holding member with keeping a gap therebetween larger than the thickness of the toner coating layer, and the nonmagnetic toner forming the layer is flied to the electrostatic latent image to develop it. The vibrating member 16 may be vibrated to any degree so long as it does contact directly with the toner-carrying member. An ac development bias and/or a dc development bias can be applied between the toner-carrying member 2 and the electrostatic image.

Figure 3:
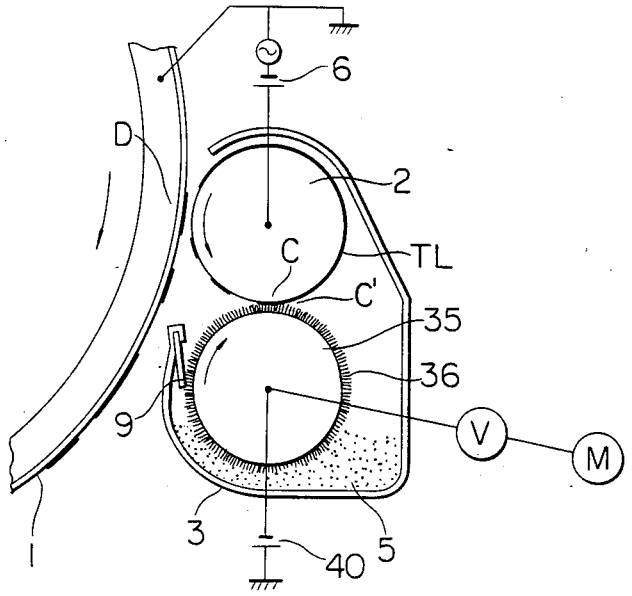

FIG. 3 illustrates another embodiment of the above development process, wherein 1: an electrostatic image holding member, 2: a toner carrying member, 35: a coating roller, 36: a fiber brush fixed on the surface of the coating roller, 6: a development bias power source, 38: a developing member, 9: a toner cleaning means, and 40: a bias power source.

In this case, a toner 5 is carried with the brush 36 by rotating the coating roller 35 and is applied thereby uniformly on the toner-carrying member 2, and flied to the electrostatic latent image to develop it. The gap between the toner-carrying member 2 and the coating roller 36 is so adjusted as to for a uniform toner layer on the toner carrying member 2. Further, the bias voltage 40 may be applied for the purpose of making the toner layer more uniform. The gap between the electrostatic image holding member 1 and the toner-carrying member 2 is adjusted to be larger than the thickness of the toner layer. For development, the development bias 6 may be applied.

Figure 4:
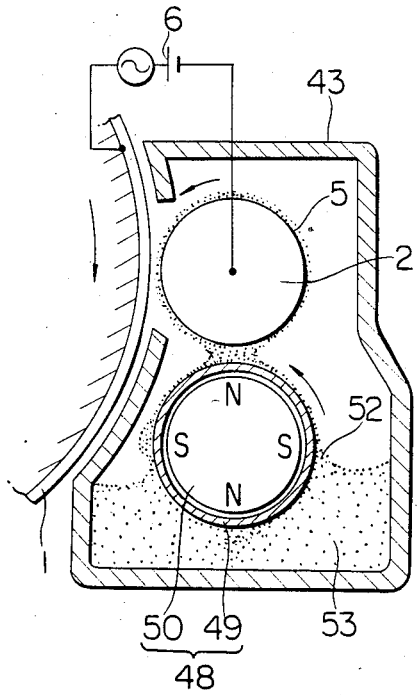

FIG. 4 illustrates another embodiment of the above development process, wherein 1: an electrostatic-image-holding member, 2: a toner-carrying member, 43: a development member, 5: a one-component nonmagnetic toner, 6: a bias source, 48: a magnetic roller, 49: a nonmagnetic sleeve, 50: a magnet, 52: a magnetic brush, and 53: a one-component nonmagnetic toner or a two-component developer consisting a nonmagnetic toner and a magnetic carrier.

In this case, the magnetic carrier is held on the nonmagnetic sleeve 49 by the action of magnetic force to form a brush, and the toner or developer 53 is drawn up with this carrier brush by rotating the nonmagnetic sleeve and is applied on the toner-carrying member 2 with contacting the brush therewith to form a uniform toner layer on the toner-carrying member 2. In this coating, the carrier does not transfer onto the toner-carrying member 2 since the carrier is held with magnetic force on the magnetic sleeve 48. Then the nonmagnetic toner is transferred from the toner-carrying member 2 onto the electrostatic image holding member 1 to develop the image. The gap between the toner-carrying member 2 and the electrostatic image holding member 1 is adjusted to be larger than the thickness of the toner layer. A development bias may be applied between the toner-carrying member 2 and the electrostatic image holding member 1.

Figure 5:
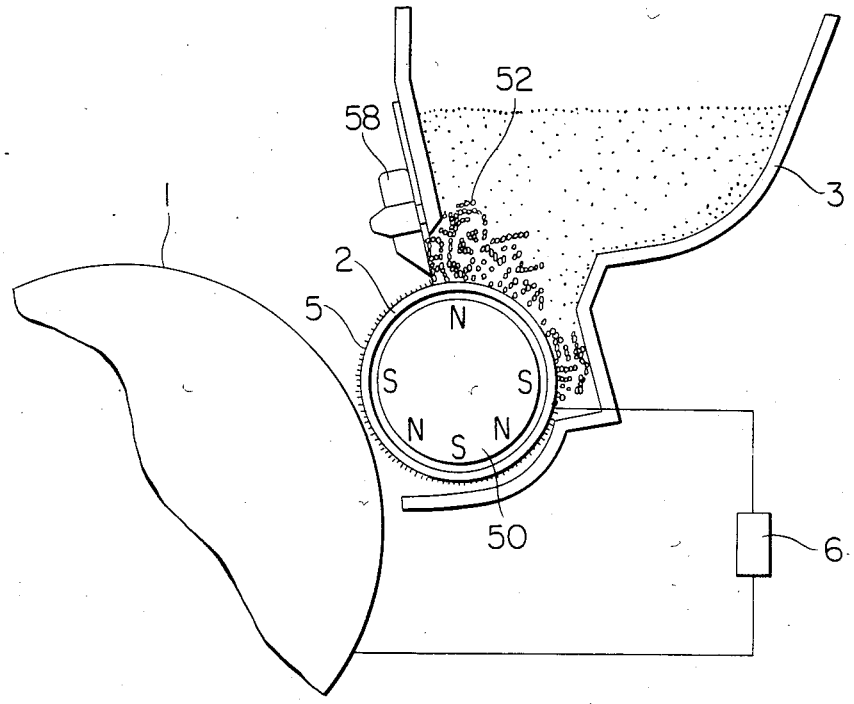

FIG. 5 illustrates another embodiment of the above development process, wherein 1: an electrostatic image holding member, 2: a toner-carrying member, 3: a hopper, 52: a magnetic brush made of a carrier-toner mixture, 58: a blade for controlling the thickness of a toner layer, 50: a fixed magnet, 6: a bias for development, and 5: a one-component nonmagnetic toner In this case, the magnetic brush 52 formed on the toner-carrying member 2 is circulated by rotating this member, the toner in the hopper 3 is taken and applied on the toner-carrying member 2 to form a thin layer. The toner-carrying member 2 is opposed to the electrostatic-image-holding member 1 with keep the gap therebetween larger than the thickness, and the one-component nonmagnetic toner 5 on the toner-carrying member 2 is flied to the electrostatic image to develop it.

The total electric charge carried by the toner layer can be controlled by varying the size of the magnetic brush 52, viz. the quantity of the carrier, and with the control blade 58. The development bias 6 can also be applied.

The invention will be understood more readily with reference to the following examples and comparative examples. In these examples the "parts" are all by weight.

EXAMPLE 1

100 parts of a styrene-butyl methacrylate (weight ratio 7:3) copolymer, 60 parts of magnetite, 3 parts of polyethylene wax, and 1.2 parts of an amino-modified silicone oil (viscosity at 25° C.: 70 cps, amino equivalent: 830) were melt-mixed on a roll mill, and after cooling, coarsely crushed with a hammer mill, then finely pulverized with a jet mill, and classified with an air classifier to give a fine powder of approximate particle sizes 5–20 μm. 100 parts of this fine powder was mixed with 0.4 part of colloidal silica to make up a toner.

This toner was subjected to a copying test using a commercial copying machine (tradename: Minicopia PC 20, made by Canon Inc. Japan), giving clear, fog-free images.

EXAMPLE 2

A toner was prepared and tested in the same manner as in Example 1 but using 100 parts of a styrene-butyl methacrylate (weight ratio 7:3) copolymer, 50 parts of $\gamma$-$Fe_2O_3$, 4 part of polyethylene wax, and 1 part of an amino-modified silicone oil (viscosity at 25° C.: 3500 cps, amine equivalent: 3800), as the toner components. This toner gave clear, fog-free, sepia colored images.

EXAMPLE 3

A toner of approximate particle sizes 5–20 μm was prepared in nearly the same manner as in Example 1 from a mixture of 80 parts of the styrene-butyl methacrylate (weight ratio 7:3) copolymer, 20 parts of a styrene-butadiene (weight ratio 85:15) copolymer, 5 parts of phthalocyanine blue, 4 parts of low molecular weight polypropylene, and 0.8 part of an amino-modified silicone oil (viscosity at 25° C.: 3500 cps, amine equivalent: 3800). Then a developer was obtained by mixing 12 parts of this toner and 88 parts of a carrier iron powder (tradename: EFV 250/400, made by Nihon Teppun Co., Ltd.).

A negative-electrostatic latent image formed on an OPC photosensitive member was developed with the above developer. The resulting powder image was transferred onto a plain paper, and fixed by using a pair of heat rolls (one being a fixing roll coated with fluororesin and the other a pressure roll coated with silicone rubber). In this way, blue, clear, fog-free images were obtained.

EXAMPLE 4

A fine powder of approximate particle sizes 5–20 μm was prepared in nearly the same manner as in Example 1 from a mixture of 100 part of a styrenebutyl acrylate (weight ratio 8:2) copolymer, 60 parts of magnetite, and 3 parts of polyethylene wax. Then, 100 parts of this fine powder was mixed with 0.05 part of an amino-modified silicone oil (viscosity at 25° C.: 70 cps, amino equivalent: 830) and 0.4 part of colloidal silica to make up a toner. In the same copying test at in Example 1, this toner gave clear, fog-free images.

EXAMPLES 5–7

Toners were prepared and tested in nearly the same manner as in Example 1 but using three different grades of silicone oil (viscosity at 25° C. and amine equivalent: 3500 cps, 2000; 90 cps, 8000; 60 cps, 22,500) respectively for the toners. All the toners gave good results.

COMPARATIVE EXAMPLES 1–4

Toners were prepared and tested in the same manner as in Example 1 but without using any amino-modified silicone oil for the toners. All the toners gave poor images only.

Test results in Examples and Comparative Examples hereinbefore are summarized in Table 2.

TABLE 2

| | Triboelectric charge (μc/g) | Image density |
|---|---|---|
| Example | | |
| 1 | 11.5 | 1.12 |
| 2 | 10.2 | 1.03 |
| 3 | 13.3 | 1.22 |
| 4 | 12.0 | 1.15 |
| 5 | 10.7 | 1.05 |
| 6 | 9.9 | 1.02 |
| 7 | 9.4 | 0.89 |
| Comparative Example | | |
| 1 | −1.3 | 0.32 |
| 2 | −0.9 | 0.21 |
| 3 | −2.4 | 0.38 |
| 4 | −1.5 | 0.28 |

EXAMPLE 8

100 parts of a styrene-butyl methacrylate (weight ratio 7:3) copolymer, 10 parts of a blue phthalocyanine pigment, 3 parts of polyethylene wax, and 1.2 parts of an amino-modified silicone oil (viscosity at 25° C.: 70 cps, amine equivalent: 830) were melt-mixed on a roll mill, and after cooling, coarsely crushed with a hammer mill, then finely pulverized with a jet mill, and classified with a pneumatic classifier to give a fine powder of approximate particle sizes 5–20 μm. 100 parts of this fine powder was mixed with 0.4 part of colloidal silica to make up a toner.

On the other hand, 100 parts of zinc oxide, 20 parts of a styrene-butadiene copolymer, 40 parts of n-butyl methacrylate, 120 parts of toluene, and 4 parts of a 1% methanolic solution of Rose Bengal were mixed for 6 hours in a ball mill to form a dispersion. The dispersion was applied on a 0.05-mm thick aluminum plate by means of a Meyer bar so as to give a dry thickness of 40 μm. After drying with warm air, the coated plate was formed into a drum. The photosensitive drum thus obtained was subjected to a −6 KV corona discharge to provide uniform charge to the entire surface of the drum, and exposed to a light through a pattern to form an electrostatic latent image on the drum.

The above obtained toner was fed in a development device as shown in FIG. 1, and the electrostatic latent image was developed with the toner. In this case, a stainless steel cylindrical sleeve of 50 mm in outer diameter was used as a toner-carrying member. The gap between the photosensitive drum and the sleeve was set to 0.25 mm, and a bias of 1000 V a.c. 400 Hz and a bias of −150 V d.c. were applied to the sleeve. Then the powder image was transferred on a transfer paper while irradiating the rear side of the transfer paper with a corona of −7 KV d.c. The resulting image was fixed by using a commercial plain-paper copying machine (tradename: NP-5000, made by Canon Inc.).

Copies obtained in this way showed good blue images of high resolution, completely free of fog. The image density was sufficiently as high as 1.5. No scattered toner spot was observed around the images.

Further the durability of respective performance with this toner was examined by repeating the above copying continuously. The results showed that the transfer image obtained after production of 50,000 copies was by no means inferior to the image obtained in the initial stage.

Under the environmental conditions of 35° C. and 85% RH, this toner gave also blue clear images without causing fogging or scattering. The image density was 1.40, being little different from the value obtained under the normal temperature and humidity conditions. The durability was also good, that is, the image quality was almost invariable during making 50,000 copies.

Also under the low temperature and humidity conditions of 10° C. and 10% RH, good transfer images were obtained. The image density was as high as 1.40. Copying of a full-face-black original image also gave good images of very uniform density, without causing the scattering or the absence of toner. Under these conditions, the durability was examined by continuous and intermittent copying tests. As a result, the variation of the image density was as small as ±0.2 during making 50,000 copies. Thus the durability was sufficient for practical use.

EXAMPLE 9

A toner was prepared and tested in the same manner as in Example 8 but using 4 parts of polyethylene wax, and 1 part of an amino-modified silicone oil (viscosity at 25° C.: 3500 cps, amine equivalent: 3800), as components of the toner. This toner gave blue clear, fog-free images, and similarly good images under high temperature and humidity conditions as well as under low temperature and humidity conditions.

EXAMPLE 10

A toner was prepared and tested in nearly the same manner as in Example 8, by using 80 parts of a styrene-butyl methacrylate (weight ratio 7:3) copolymer, 20 parts of a styrene-butadiene (weight ratio 85:15) copolymer, 5 parts of phthalocyanine blue, 5 parts of a low molecular weight polypropylene, and 0.8 part of an amino-modified silicone oil (viscosity at 25° C.: 3500 cps, amino equivalent: 3800), as components of the toner. This toner also gave blue, clear, fog-free images.

EXAMPLE 11

A fine powder of particle sizes 5–20 μm was prepared in nearly the same manner as in Example 8, by using 100 parts of a styrene-butyl acrylate (weight ratio 8:2) copolymer, 10 parts of a phthalocyanine blue pigment, and 3 parts of polyethylene wax. Then, 100 parts of this fine powder was mixed with 0.05 part of an amino-modified silicone oil (viscosity at 25° C.: 70 cps, amino equivalent: 830) and 0.4 part of colloidal silica to make up a toner.

In the same copying tests as in Example 8, this toner gave blue, clear, fog-free images.

EXAMPLES 12–14

Toners were prepared and tested in the same manner as in Example 8 but using different grades of amino-modified silicone oil (viscosity at 25° C. and amino equivalent: 3500 cps, 2000; 90 cps, 8800; 60 cps, 22,500), respectively as toner components. The results were similarly good.

EXAMPLE 15

The toner prepared in Example 8 was fed in a development device as shown in FIG. 2. The vibrating member 16 was operated at a frequency of about 50 Hz and an amplitude of 0.2 mm and the toner-carrying member 2 was rotated at a peripheral velocity of 120 mm/sec., thereby forming a uniform toner coating layer about 50 μm thick on the toner-carrying member 2. While keeping the gap of approx. 300 μm between the toner-carrying member 2 and the image-holding member 1 development was conducted by exerting an electric field generated by an a.c. current having frequency of hundreds to thousands; minus peak value of 31 600 to −1200 V; and plus peak value of +400 to +800 V, on the toner-carrying member 2. Thus, similar good results were obtained.

EXAMPLE 16

The toner prepared in Example 8 was fed in a development device as shown in FIG. 3, wherein the gap between the toner-carrying member 2 and the coating roller 35 was set to about 2 mm and the length of the fiber brush 36 to about 3 mm. Then, the gap between the development roller and the electrostatic-image-holding member was kept at 300 μm, and a toner layer about 80 μm thick was formed on the development roller. Development was conducted by exerting an electric field generated by an a.c. current having plus peak value of +700 V and minus peak value of −200 V, these values being obtained by applying a d.c. current of 250 V onto an a.c. current having a frequency of 200 Hz and a peak voltage of ±450 V, on the toner-carrying member 2. Thus, similar good results were obtained.

EXAMPLE 17

The toner prepared in Example 8 was fed in a development device as shown in FIG. 4, wherein the gap between the toner-carrying member 2 and the magnetic roller 48 was set to about 2 mm and the maximum thickness of the magnetic brush 52 to about 3 mm. Then, the gap between the development roller and the electrostatic-image-holding member was kept at 300 μm, and a toner layer about 80 μm thick was formed on the development roller. Development was conducted by exerting an a.c. electric field generated by an a.c. current having plus peak value of +700 V and minus peak value of −200 V, these values being obtained by applying a d.c. current of 250 V onto an a.c. current having a frequency of 200 Hz and a peak voltage of ±450 V, on the toner-carrying member 2. Thus, similar good results were obtained.

EXAMPLE 18

A mixture of 20 g of the toner prepared in Example 8 and 20 g of a carrier iron powder was fed in a development device as shown in FIG. 5, wherein the gap between the controlling blade 58 and the toner-carrying member 2 was set to about 250 μm. Then the gap between the development roller and the electrostatic-image-holding member was kept at 300 μm, and a toner layer about 80 μm thick was formed on the development roller. Development was conducted by exerting an a.c. electric field generated by an a.c. current having plus peak value of +700 V and minus peak value of −200 V, these values being obtained by applying a d.c. current of 250 V onto an a.c. current having a frequency of 200 Hz and a peak voltage of ±450 V, on the toner-carrying member 2. Thus, similar good results were obtained.

COMPARATIVE EXAMPLES 5–8

Toners were prepared and tested in the same manner as in Examples 8–11, respectively, but no amino-modified silicone oil was incorporated in the toner. The resulting images were poor.

EXAMPLE 19

100 parts of a styrene-butyl methacrylate (weight ratio 7:3) copolymer, 60 parts of magnetite, 3 parts of polyethylene wax, and 15 parts of calcium carbonate (specific surface area 18 $m^2/g$) treated with an amino-modified silicone oil (viscosity at 25° C.: 70 cps, amino equivalent: 830) and impregnated with 20 wt. % of the oil were melt-mixed on a roll mill, and after cooling, coarsely crushed with a hammer mill, then finely pulverized with a jet mill, and classified with a pneumatic classifier to give a fine powder of approximate particle sizes 5–20 μm. 100 parts of this fine powder was mixed with 0.4 part of colloidal silica to make up a toner.

This toner was subjected to a copying test using a commercial copying machine (tradename: Minicopia PC 20, made by Canon Inc.), giving clear, fog-free images. Good images were also obtained under high temperature and humidity conditions (30° C., 90% RH).

EXAMPLE 20

A toner was prepared and tested in the same manner as in Example 19 but using 50 part of γ-iron oxide, 4 parts of polyethylene wax, 20 parts of titanium oxide (oil absorption 10 wt. %, specific surface area 10 $m^2/g$) treated with an amino-modified silicone oil (viscosity at 25° C.: 3500 cps, amine equivalent: 3800), as components of the toner. The resulting copies showed sepia, clear, fog-free images. Good images were also obtained under high temperature and humidity conditions.

EXAMPLE 21

A toner of approximate particle sizes 5–20 μm was prepared in nearly the same manner as in Example 19, by using 80 parts of a styrene-butyl methacrylate (weight ratio 7:3) copolymer, 20 parts of a styrene-butadiene (weight ratio 85:15) copolymer, 5 parts of phthalocyanine blue, and 13 parts of cerium oxide (specific surface area 27 $m^2/g$) treated with an amino-modified silicone oil (viscosity at 25° C.: 3500 cps, amine equivalent: 3800) and impregnated with 12 wt. % of said oil. 12 parts of this toner was mixed with 88 parts of a carrier iron powder (tradename: EFC 250/400, made by Nihon Teppun Co., Ltd.) to make up a developer. A negative electrostatic latent image was formed on an OPC photosensitive member, and developed with the above developer. The resulting powder image was transferred onto a plain paper, and fixed by means of a pair of heat rolls (one being a fixing roll coated with fluororesin and the other being a pressure roll coated with silicon rubber). In this way, blue, clear, fog-free images were obtained.

EXAMPLE 22

Clear fog-free images were obtained in nearly the same manner as in Example 19 by using a magnetite (oil absorption 3 wt. %, specific surface area 5 $m^2/g$) treated with an amino-modified silicone oil (viscosity at 25° C.: 70 cps, amine equivalent: 830), in place of the magnetite treated with the amino-modified silicone oil, for the toner preparation.

EXAMPLES 23–25

Good results were obtained in the same manner as in Example 19 but using different grades of amino-modified silicone oil (viscosity at 25° C. and amine equivalent: 3500 cps, 2000; 90 cps, 8800; 60 cps, 22,500), respectively for the toner preparations.

COMPARATIVE EXAMPLE 12

A developer was prepared and tested in the same manner as in Example 19 but using a fine powder of silica treated with an aminosilane ($H_2N(CH_2)_4Si(OC_2H_5)_3$) in place of the calcium carbonate treated with an amino-modified silicone oil. This toner gave good images under normal environmental conditions, but poor images under high temperature and humidity conditions.

Test results of Examples 19–25 and Comparative Examples 9–12 are summarized in Table 3.

TABLE 3

| | Tribo-electric charge (μc/g) | Image density: Normal conditions (20° C., 60% RH) | Image density: High temp. High humidity (30° C., 90% RH) |
|---|---|---|---|
| Example | | | |
| 19 | 12.7 | 1.20 | 1.08 |
| 20 | 10.5 | 1.05 | 1.02 |
| 21 | 12.4 | 1.25 | 1.19 |
| 22 | 11.2 | 1.16 | 1.07 |
| 23 | 11.9 | 1.09 | 1.01 |
| 24 | 10.2 | 1.08 | 1.00 |
| 25 | 9.6 | 0.97 | 0.91 |
| Comparative Example | | | |
| 9 | −1.3 | 0.32 | — |
| 10 | −0.9 | 0.21 | — |
| 11 | −2.4 | 0.28 | — |
| 12 | 11.7 | 1.18 | 0.63 |

EXAMPLE 26

100 parts of a styrene-butyl methacrylate (weight ratio 7:3) copolymer, 10 parts of a blue phthalocyanine pigment, 3 parts of polyethylene wax, and 15 parts of calcium carbonate (specific surface area 18 $m^2/g$) treated with an amino-modified silicone oil (viscosity at 25° C.: 70 cps, amine equivalent: 830) and impregnated with 20 wt. % of said oil were melt-mixed on a roll mill, and after cooling, coarsely crushed with a hammer mill, then finely pulverized with a jet mill, and classified by a pneumatic classifier to give a fine powder of approximate particle sizes 5–20 μm. 100 parts of this fine powder was mixed 0.4 part of colloidal silica to make up a toner.

On the other hand, 100 parts of zinc oxide, 20 parts of a styrene-butadiene copolymer, 40 parts of n-butyl methacrylate, 120 parts of toluene, and 4 parts of a 1% methanolic solution of Rose Bengal were mixed for 6 hours in a ball mill to form a dispersion. This dispersion was applied on an 0.05-mm thick aluminum plate by means of a Meyer bar so as to give a dry thick of 40 μm. After drying with warm air, the coated plate was formed into a drum. The photosensitive drum thus obtained was subjected to a −6 KV corona discharge to provide uniform charge to the entire surface thereof, and then was exposed to a light through a pattern to form an electrostatic latent image thereupon.

The above obtained toner was fed in a development device as shown in FIG. 1, and the electrostatic latent image was developed with the toner. In this case, a stainless steel cylindrical sleeve of 50 mm in outer diameter was used as a toner-carrying member, the gap between the photosensitive drum and the sleeve was set to 0.25 mm, and a bias of 1000 V s.c. 400 Hz and a bias of −150 V d.c. were applied to the sleeve. Then the powder image was transferred on a transfer paper while irradiating the rear side of the transfer paper with a corona of −7 KV d.c. The resulting image was fixed by using a commercial plain-paper copying machine (tradename: NP-5000, made by Canon Inc.) The obtained copy showed a good blue image of high resolution, completely free of fog. The image density was sufficiently as high as 1.5. No scattered toner spot was observed around the images.

Further the repetitive performance with this toner was tested by repeating the above copying continuously. The results showed that the transfer image obtained after production of 50,000 copies was by no means inferior to the image obtained in the initial stage.

Under the environmental conditions of 35° C. and 85% RH, this toner also gave blue clear images without causing fogging or the scattering. The image density was 1.40, being little different from the value obtained under the normal temperature and humidity conditions. The durability was also good, that is, the image quality was almost invariable during making 50,000 copies.

Also under the low temperature and humidity conditions of 10° C. and 10% RH, good transfer images were obtained, the image density was as high as 1.40, and copying of a full-face-black original image also gave good images of very uniform density without causing the scattering or the absence of toner. Under these conditions, the repetitive performance was also examined by continuous and intermittent copying tests. As a result, the variation of the image density was as small as ±0.2 during making 50,000 copies, indicating that the repetitive performance is sufficient for practical use.

EXAMPLE 27

A toner was prepared and tested in the same manner as in Example 26 but using 5 parts of a blue phthalocyanine pigment, 4 parts of polyethylene wax, and 20 parts of titanium oxide (oil absorption 10 wt. %, specific surface area 10 $m^2/g$), as components of the toner. This toner gave blue, clear, fog-free images, and similarly good images under high temperature and humidity conditions as well as under low temperature and humidity conditions.

EXAMPLE 28

A toner of approximate particle size 5–20 μm was prepared in nearly the same manner as in Example 26 by mixing 80 parts of a styrene-butyl methacrylate (weight ratio 7:3) copolymer, 20 parts of a styrene-butadiene (weight ratio 85:15) copolymer, 5 parts of phthalocyanine blue, 4 parts of low molecular weight polypropylene, and 13 parts of cerium oxide (specific surface area 27 $m^2/g$) treated with an amino-modified silicone oil (viscosity at 25° C.: 3500 cps, amine equivalent: 3800) and impregnated with 12 wt. % of said oil. Copying with this toner conducted as in Example 26 gave blue clear, fog-free images.

EXAMPLES 29–31

Toners were prepared and tested in the same manner as in Example 26 but using different grades of amino-modified silicone oil (viscosity at 25° C. and amino equivalent: 3500 cps, 2000; 90 cps, 8800; 60 cps, 22,500, respectively as toner components. Similar good results were obtained.

EXAMPLE 32

The toner prepared in Example 26 was fed in a development device as shown in FIG. 2. The vibrating member 16 was operated at a frequency of about 50 Hz and an amplitude of 0.2 mm and the toner-carrying member 2 was rotated at a peripheral velocity of 120 mm/sec., thereby forming a uniform toner coating layer about 50 μm thick on the toner-carrying member 2. While keeping the gap between the toner-carrying member 2 and the image-holding member 1 at about 300 μm, development was conducted by exerting an a.c. electric field generated by an a.c. current having a frequency hundreds to thousands; minus peak value, −600 to −1200 V; plus peak value, +400 to +800 V, to the toner-carrying member 2. Similar good results were obtained.

EXAMPLE 33

The toner prepared in Example 26 was fed in a development device as shown in FIG. 3, wherein the gap between the toner-carrying member 2 and the coating roller 35 was set to about 2 mm and the length of the fiber brush 36 to about 3 mm. Then, the gap between the development roller and the electrostatic-image-holding member was kept at 300 μm, and a toner layer about 80 μm thick was formed on the development roller. Development was conducted by exerting an a.c. electric field generated by an a.c. current (a.c. component: frequency, 200 Hz, voltage peak; ±450 V; d.c. component: voltage, +250 V; the resulting voltage peak, +700 V to −200 V) to the toner-carrying member 2. Thus, similar good results were obtained.

EXAMPLE 34

The toner prepared in Example 26 was fed in a development device as shown in FIG. 4, wherein the gap between the toner-carrying member 2 and magnetic roller 48 was set to about 2 mm and the maximum thickness of the magnetic brush 52 to about 3 mm. Then, the gap between the development roller and the electrostatic-image-holding member was kept at 300 μm, and a toner layer about 80 μm thick was formed on the development roller. Development was conducted by exerting an a.c. electric field generated by an a.c. current (a.c. component: frequency, 200 Hz, voltage peak, ±450 V; d.c. component: voltage, +250 V; the resulting voltage peak: +700 V to −200 V) on the toner-carrying member 2. Thus, similar good results were obtained.

EXAMPLE 35

A mixture of 20 g of the toner prepared in Example 26 and 20 g of a carrier, iron powder, was fed in a development device as shown in FIG. 5, wherein the gap between the controlling blade 58 and the toner-carrying member 2 was set to about 250 μm. Then the gap between the development roller and the electrostatic-image-holding member was kept at 300 μm, and a toner layer about 80 μm thick was formed on the development roller. Development was conducted by exerting an a.c. electric field generated by an a.c. current (a.c. component: frequency, 200 Hz, voltage peak, ±450 V; d.c. component: voltage +250 V; the resulting voltage peak: +700 V to −200 V) on the toner-carrying member 2. Thus, similar good results were obtained.

COMPARATIVE EXAMPLES 13–15

Toners were prepared and tested in the same manner as in Examples 26–28, respectively, but no inorganic fine powder treated with an amino-modified silicone oil was incorporated into the toner. The resulting images were poor.

COMPARATIVE EXAMPLE 16

A toner was prepared and tested in the same manner as in Example 26 but using a fine powder of silica treated with an aminosilane ($H_2N(CH_2)_4Si(OC_2H_5)_3$) in place of the calcium carbonate treated with an amino-modified silicone oil. This toner gave good images under normal environmental conditions, but poor images under high temperature and humidity conditions.

EXAMPLE 36

100 parts of a styrene-butyl methacrylatedimethylaminoethyl methacrylate (weight 7:2.5:0.5) copolymer, 60 parts of magnetite, and 3 parts of polyethylene wax were melt-mixed on a roll mill, and after cooling, coarsely crushed with a hammer mill, then finely pulverized with a jet mill, and classified with a pneumatic classifier. Thus, a black fine powder of approximate particle sizes 5–20 μm was obtained.

On the other hand, 100 parts of a fine powder of silica (tradename: Aerosil #130, specific surface area: about 130 $m^2/g$, made by Aerosil Co., Ltd. in a dry process) was sprayed with 20 parts of a silicone oil having an amine on its side chain (viscosity at 25° C.: 70 cps, amine equivalent: 830) at about 250° C. with stirring, thus being treated for 10 minutes.

100 parts of the above black fine powder was mixed with 0.4 part of the silicone oil treated fine powder of silica to make up a toner.

This toner was subjected to a copying test using a commercial copying machine (tradename: Minicopia PC 20, made by Canon Inc.), giving clear, fog-free images, the reflection density of which was 1.15. Further the repetitive performance with this toner was examined by repeating the above copying 10,000 times. The results showed that the initial clear, fog-free image quality (image density 1.18) was maintained during the test. Similar copying conducted under high temperature and humidity conditions (30° C., 90% RH) gave images free of such defects as fog, the optical density of which was 1.06. Also under low temperature and humidity conditions (10° C., 10% RH), clear, fog-free images were obtained.

EXAMPLE 37

A fine powder prepared in the same manner as in Example 36 but using 50 partsof γ-iron oxide, and 4 parts of polyethylene wax.

On the other hand, 100 parts of a fine powder of silica (tradename: Aerosil OX-50, specific surface area: about 50 $m^2/g$, made by Aerosil Co., Ltd. in a dry process) was treated with 1 part of a silicone oil having an amine on its side chain (viscosity at 25° C.: 60 cps, amine equivalent: 360) in the same manner as in Example 36.

100 parts of the above fine powder was mixed with 1 part of the silicone oil treated fine powder of silica to make up a toner. Copying for evaluating this toner, conducted in the same manner as in Example 36, gave sepia, clear, fog-free images.

EXAMPLE 38

A blue fine powder of approximate particle sizes 5–20 μm was prepared in nearly the same manner as in Example 36, by using 80 parts of a styrene-butyl methacrylate-dimethylaminoethyl methacrylate (weight ratio 7:2.5:0.5) copolymer, 20 parts of a styrene-butadiene (weight ratio 85:15) copolymer, 6 parts of phthalocyanine blue, and 4 parts of low molecular weight polypropylene.

On the other hand, 100 parts of a fine powder of silica (tradename: Aerosil #200, specific surface area: about 200 $m^2/g$, made by Aerosil Co., Ltd. in a dry process) was treated with 100 parts of a silicone oil having an amine on its side chain (viscosity at 25° C.: 3500 cps, amine equivalent: 3800) in the same manner as in Example 36.

Then, 12 parts of the above blue fine powder wax mixed with 0.3 part of the treated fine powder of silica and 88 parts of a carrier iron powder (tradename: EFV 250/400, made by Nihon Teppun Co., Ltd.) to make up a developer.

A negative-electrostatic latent image formed on an OPC photosensitive member was developed with the above developer. The formed powder image was transferred onto a plain paper and fixed by means of a pair of heat rolls (one being a fixing roll coated with fluororesin and the other a pressure roll coated with silicone rubber). In this way, blue, clear, fog-free images were obtained.

EXAMPLE 39

Clear, fog-free images were obtained in nearly the same manner as in Example 36 but using 100 parts of a fine powder of silica, synthesized in a wet process, having a specific surface area of about 90 $m^2/g$ and 10 parts of a silicone oil having an amine on its side chain (vicsocisty at 25° C.: 1300 cps, amine equivalent: 1700), for the toner preparation.

EXAMPLE 40

Clear, fog-free images were obtained in nearly the same manner as in Example 36 but using 100 parts of a fine powder of silica (tradename: Aerosil #380, made by Aerosil Co., Ltd. in a dry process) having a specific surface area of 380 $m^2/g$ and 40 parts of a silicone oil having an amine on its side chain (viscosity at 25° C.: 750 cps, amine equivalent: 1900), for the toner preparation.

EXAMPLE 41

Clear, fog-free images were obtained in nearly the same manner as in Example 36 but using 100 parts of a fine powder of silica, synthesized in a wet process, having a specific surface area of about 120 $m^2/g$ and 15 parts of a silicone oil having an amine on its side chain (viscosity at 25° C.: 1200 cps, amine equivalent: 3500), for the toner preparation.

EXAMPLES 42–48

Good results were obtained in nearly the same manner as in Example 36 but using different grades of silicone oil having an amine on its side chain (viscosity at 25° C. and amine equivalent: 250 cps, 7600; 3500 cps, 2000; 1700 cps, 3800; 90 cps, 4000; 20 cps, 320; 90 cps, 8800; 2300 cps, 3800) for the respective toner preparations.

EXAMPLE 49

A toner was prepared and tested in nearly the same manner as in Example 36 but using 98 parts of a silicone oil having an amine on its side chain (viscosity of 60 cps at 25° C. and an amine equivalent 22,500) for the toner preparation. Image obtained were good though slightly inferior to those of Example 36. The image density was 0.83.

COMPARATIVE EXAMPLE 17

A toner was prepared and tested in nearly the same manner as in Example 36 but using the fine powder of silica, as such, not treated with the silicone oil having an amine on its side chain. Resulting images were poor, having a density of 0.21.

COMPARATIVE EXAMPLE 18

A toner was prepared and tested in nearly the same manner as in Example 36 but using an aminosilane coupling agent in place of the silicone oil, which has an amine on its side chain, for the treatment of the fine powder of silica. This toner gave an image density of 0.91 under normal temperature and humidity condition. However, under high temperature and humidity conditions, the toner gave a markedly lowered image density of 0.34, forming such poor images only.

Image densities resulting under different environmental conditions in Examples 36–49 and Comparative Examples 17 and 18 are summarized in Table 4.

TABLE 4

| | Image density | | |
|---|---|---|---|
| | Normal temperature, normal humidity (20° C., 60% RH) | High temperature, high humidity (30° C., 90% RH) | Low temperature low humidity (10° C., 10% RH) |
| Example | | | |
| 36 | 1.15 | 1.06 | 1.19 |
| 37 | 1.23 | 1.04 | 1.18 |
| 38 | 1.07 | 0.98 | 1.10 |
| 39 | 1.13 | 1.10 | 1.15 |
| 40 | 1.16 | 1.07 | 1.13 |
| 41 | 1.20 | 1.09 | 1.13 |
| 42 | 1.05 | 0.96 | 1.09 |
| 43 | 1.11 | 1.08 | 1.10 |
| 44 | 1.08 | 1.02 | 1.06 |
| 45 | 1.09 | 1.01 | 1.02 |
| 46 | 1.25 | 1.13 | 1.14 |
| 47 | 1.02 | 0.95 | 1.05 |
| 48 | 1.07 | 0.97 | 1.01 |
| 49 | 0.83 | 0.79 | 0.85 |
| Comparative Example | | | |
| 17 | 0.21 | 0.13 | 0.18 |
| 18 | 0.91 | 0.34 | 1.03 |

EXAMPLE 50

100 parts of a styrene-butyl methacrylatedimethylaminoethyl methacrylate (weight ratio 7:2.5:0.5), 10 parts of a blue phthalocyanine pigment, and 3 parts of polyethylene wax were melt-mixed on a roll mill, and after cooling, coasely crushed with a hammer mill, then finely pulverized with a jet mill, and classified with a pneumatic classifier to give a blue fine powder of approximate particle sizes 5–20 μm.

On the other hand, 100 parts of a fine powder of silica (tradename: Aerosil #130, specific surface area: about 130 $m^2/g$, made by Aerosil Co., Ltd. in a dry process) was sprayed with 20 parts of a silicone oil having an amine on its side chain (viscosity at 25° C.: 70 cps, amine equivalent: 830) at about 250° C. with stirring, thus being treated for 10 minutes.

Then, 100 parts of the above blue fine powder was mixed with 0.4 part of the silicone oil-treated fine powder of silica to make up a toner.

On the other hand, 100 parts of zinc oxide, 20 parts of a styrene-butadiene copolymer, 40 parts of n-butyl methacrylate, 120 parts of toluene, and 4 parts of a 1% methanolic solution of Rose Bengal were mixed for 6 hours in a ball mill to form a dispersion. This dispersion was applied on an 0.05 mm thick aluminum plate by means of a Meyer bar so as to give a dry thickness of 40 μm. After drying by blowing warm air, the coated plate was formed into a drum. The photosensitive drum thus obtained was subjected to a −6 KV corona discharge to provide uniform charge to the entire surface thereof, and then was exposed to a light through a pattern to form an electrostatic latent image thereupon.

The above obtained toner was fed in a development device as shown in FIG. 1, and the electrostatic latent image was developed with the toner. In this case, a stainless steel cylindrical sleeve of 50 mm in outer diameter was used as a toner-carrying member, the gap between the photosensitive drum and the sleeve was set to 0.25 mm, and a bias of 1000 V a.c. 400 Hz and a bias of −150 V d.c. were applied to the sleeve. Then the powder image was transferred on a transfer paper while irradiating the rear side of the transfer paper with a corona of −7 KV d.c. The resulting image was fixed by using a commercial plain-paper copying machine (tradename: NP-5000, made by Canon Inc.)

The obtained copies showed good blue images of high resolution, completely free of fog. The image density was sufficiently as high as 1.45. No scattered toner spot was observed around the images. The repetitive performance with this toner was examined by repeating the above copying continuously. The results showed that the transfer image obtained after production of 50,000 copies was by no means inferior to the image obtained in the initial stage.

Under the environmental conditions of 30° C. and 90% RH, this toner also gave blue clear images without causing fogging or the scattering. The image density was 1.40, being little different from the value obtained under the normal temperature and humidity conditions. The repetitive performance was also good, that is, the image quality was almost invariable up to the production of 50,000 copies.

Also under the low temperature and humidity conditions of 10° C. and 10% RH, good transfer images were obtained, the image density was as high as 1.40, and copying of a full-face-black original image also gave good images of very uniform density without causing the scattering or the absence of toner. Under these conditions, the repetitive performance with the toner was also examined by continuous and intermittent copying tests. As a result, the variation of the image density was as small as ±0.2 during the production of 50,000 copies, indicating that the repetitive performance is sufficient for practical use.

EXAMPLE 51

A fine powder was prepared in the same manner as in Example 50 but using 4 parts of polyethylene wax.

Further, 100 parts of a fine powder of silica (tradename: Aerosil OX-50, specific surface area: about 50 $m^2/g$, made by Aerosil Co., Ltd. in a dry process) was treated with 1 part of a silicone oil having an amine on its side chain (viscosity at 25° C.: 60 cps, amine equivalent: 360) in the same manner as in

EXAMPLE 50.

Then, 100 parts of the above fine powder was mixed with 1 part of the silicone oil treated fine powder of silica to make up a toner. Copying for evaluating this toner, conducted in the same manner as in Example 50, gave blue, clear, fog-free images. Good images were also obtained under hiqh temperature and humidity conditions as well as under low temperature and humidity conditions.

EXAMPLE 52

A blue fine powder of approximate particle sizes 5–20 μm was prepared in nearly the same manner as in Example 50 but using 80 parts of a styrene-butyl methacrylate-dimethylaminoethyl methacrylate (weight ratio 7:2.5:0.5), 20 parts of a styrene-butadiene (weight ratio 85:15) copolymer, 6 parts of phthalocyanine blue, and 4 parts of low molecular weight of polypropylene.

On the other hand, 100 parts of a fine powder of silica (tradename: Aerosil #200, specific surface area: about 200 $m^2/g$, made by Aerosil Co., Ltd. in a dry process) was treated with 100 parts of a silicone oil having an amine on its side chain (viscosity at 25° C.: 3500 cps, amine equivalent: 3800) in the same manner as in Example 50.

Thereafter, a toner was prepared and evaluated in the same manner as in Example 50, giving good results.

EXAMPLE 53

Clear, fog-free images were obtained in nearly the same manner as in Example 50 but using 100 parts of a fine powder of silica, synthesized by a wet process, having a specific surface area of about 90 $m^2/g$ and 10 parts of a silicone oil having an amide on its side chain (viscosity at 25° C.: 1300 cps, amine equivalent: 1700), for the toner preparation.

EXAMPLE 54

Clear, fog-free images were obtained in nearly the same manner as in Example 50 but using 100 parts of a fine powder of silica (tradename: Aerosil #380, specific surface area: about 380 $m^2/g$, made by Aerosil Co., Ltd. in a dry process) and 40 parts of a silicone oil having an amine on its side chain (viscosity at 25° C.: 750 cps, amine equivalent: 1900), for the toner preparation.

EXAMPLE 55

Clear, fog-free images were obtained in nearly the same manner as in Example 50 but using 100 parts of a fine powder of silica, synthesized by a wet process, having a specific surface area of about 120 $m^2/g$ and 15 parts of a silicone oil having an amine on its side chain (viscosity at 25° C. 1200 cps, amine equivalent: 3500), for the toner preparation.

EXAMPLES 56–62

Good results were obtained in nearly the same manner as in Example 50 but using different grades of silicone oil having an amine on its side chain (viscosity at 25° C. and amine equivalent: 250 cps, 7600; 3500 cps, 2000; 1700 cps; 3800; 90 cps, 4000; 20 cps, 320; 90 cps, 8800; 2300 cps, 3800) for the respective toner preparations.

EXAMPLE 63

A toner was prepared and tested in nearly the same manner as in Example 50 but using 98 parts of a silicone oil having a viscosity of 60 cps at 25° C. and an amine equivalent 22,500 for the toner preparation. Images obtained were good though slightly inferior to those of Example 50. The image density was 0.83.

COMPARATIVE EXAMPLE 19

A toner was prepared and tested in nearly the same manner as in Example 50 but using the fine powder of silica, as such, not treated with the silicone oil having an amine on its side chain. Resulting images were poor, having a density of 0.18.

COMPARATIVE EXAMPLE 20

A toner was prepared and tested in nearly the same manner as in Example 50 but using an aminosilane coupling agent in place of the silicone oil, which has an amine on its side chain, for the treatment of the fine powder of silica. This toner gave an image density of 0.85 under normal temperature and humidity conditions. However, under high temperature and humidity conditions, the toner gave a markedly lowered image density of 0.30, forming such poor images only.

Image densities resulting under different environmental conditions in Examples 50–63 and Comparative Examples 19 and 20 are summarized in Table 5.

TABLE 5

| | Image density | | |
|---|---|---|---|
| | Normal temperature, normal humidity (20° C., 60% RH) | High temperature, high humidity (30° C., 90% RH) | Low temperature low humidity (10° C., 10% RH) |
| Example | | | |
| 50 | 1.45 | 1.40 | 1.40 |
| 51 | 1.40 | 1.35 | 1.42 |
| 52 | 1.50 | 1.40 | 1.43 |
| 53 | 1.23 | 1.20 | 1.25 |
| 54 | 1.35 | 1.35 | 1.40 |
| 55 | 1.40 | 1.35 | 1.42 |
| 56 | 1.28 | 1.25 | 1.35 |
| 57 | 1.29 | 1.25 | 1.35 |
| 58 | 1.36 | 1.30 | 1.40 |
| 59 | 1.20 | 1.15 | 1.25 |
| 60 | 1.20 | 1.20 | 1.25 |
| 61 | 1.50 | 1.35 | 1.45 |
| 62 | 1.43 | 1.25 | 1.43 |
| 63 | 0.83 | 0.75 | 0.80 |
| Comparative Example | | | |
| 19 | 0.18 | 0.13 | 0.18 |
| 20 | 0.85 | 0.30 | 1.03 |

EXAMPLE 64

The toner prepared in Example 50 was fed in a development device as shown in FIG. 2. The vibrating member 16 was operated at a frequency of about 50 Hz and an amplitude of 0.2 mm and the tonercarrying member 2 was rotated at a peripheral velocity of 120 mm/sec., thereby forming a uniform toner coating layer about 50 μm thick on the tonercarrying member 2. While keeping the gap between the toner-carrying member 2 and the image-holding member 1 at about 300 μm, development was conducted by exerting an a.c. electric field generated by an a.c. current (frequency: hundres-thousands; minus peak value, −600 to −1200 V; plus peak value, +400 to +800 V) to the toner-carrying member 2. Similar good results were obtained.

EXAMPLE 65

The toner prepared in Example 50 was fed in a development device as shown in FIG. 3, wherein the gap between the toner-carrying member 2 and the coating roller 35 was set to about 2 mm and the length of the fiber brush 36 to about 3 mm. Then, the gap between the development roller and the electrostatic-image-holding member was kept at 300 μm, and a toner layer about 80 μm thick was formed on the development roller. Development was conducted by an a.c. electric field generated by an a.c. current (a.c. component: frequency 200 Hz, voltage peak, ±450 V; d.c. component: voltage, +250 V; the resulting voltage peak: +700 V to −200 V) to the toner-carrying member 2. Thus, similar good results were obtained.

EXAMPLE 66

The toner prepared in Example 50 was fed in a development device as shown in FIG. 4, wherein the gap between the toner-carrying member 2 and the magnetic roller 48 was set to about 2 mm and the maximum thickness of the magnetic brush 52 to about 3 mm. Then, the gap between the development roller and the electrostatic-image-holding member was kept at 300 μm, and a toner layer about 80 μm thick was formed on the development roller. Development was conducted by exerting an a.c. electric field generated by an a.c. current (a.c. component: frequency, 200 Hz, voltage peak, 450 V; d.c. component: voltage, 250 V; the resulting voltage peak: +700 V to −200 V) on the toner-carrying member 2. Thus, similar good results were obtained.

EXAMPLE 67

A mixture of 20 g of the toner prepared in Example 50 and 20 g of a carrier iron powder was fed in a development device as shown in FIG. 5, wherein the gap between the controlling blade 58 and the toner carrying member 2 was set to about 250 μm. Then, the gap between the development roller and the electrostatic-image-holding member was kept at 300 μm, and a toner layer about 80 μm thick was formed on the development roller. Development was conducted by exerting an a.c. electric field generated by an a.c. current (a.c. component: frequency, 200 Hz, voltage peak, ±450 V; d.c. component: voltage, 250 V; the resulting voltage peak: 700 V to −200 V) on the toner-carrying member 2. Thus, similar good results were obtained.

EXAMPLE 68

100 part of a styrene-butyl methacrylatedivinylbenzene (weight ratio 70:30:0.5) copolymer (M.I. 1.4g/10mm at 110° C., 10 kg load), 60 parts of magnetite, 3 parts of nigrosine dye, 5 parts of polyethylene wax, and 20 parts of a fine powder of silica (specific surface area: about 130 $m^2/g$) which had been treated with 40 wt. % of a silicone oil (viscosity at 25° C.: 70 cps, amine equivalent: 830) having an amine on its side chain were melt-mixed on a roll mill, and after cooling, coarsely crushed with a hammer mill, then finely pulverized with a jet mill, and classified with a pneumatic classifier. Thus, a black fine powder of approximate particle sizes 5–20 μm was obtained.

On the other hand, 100 parts of a fine powder of silica (specific surface area: about 130 $m^2/g$) synthesized by a dry process was sprayed with 20 parts of a silicone oil (viscosity at 25° C.: 70 cps, amine equivalent: 830) having an amine on its side chain, with stirring at 250° C., thus being treated for 10 minutes.

Then, 100 parts of the above black fine powder was mixed with 0.4 part of the silicone oil-treated fine powder of silica to make up a toner. The MI of this toner was 2.6 (125° C., 10 kg load).

Figure 6:
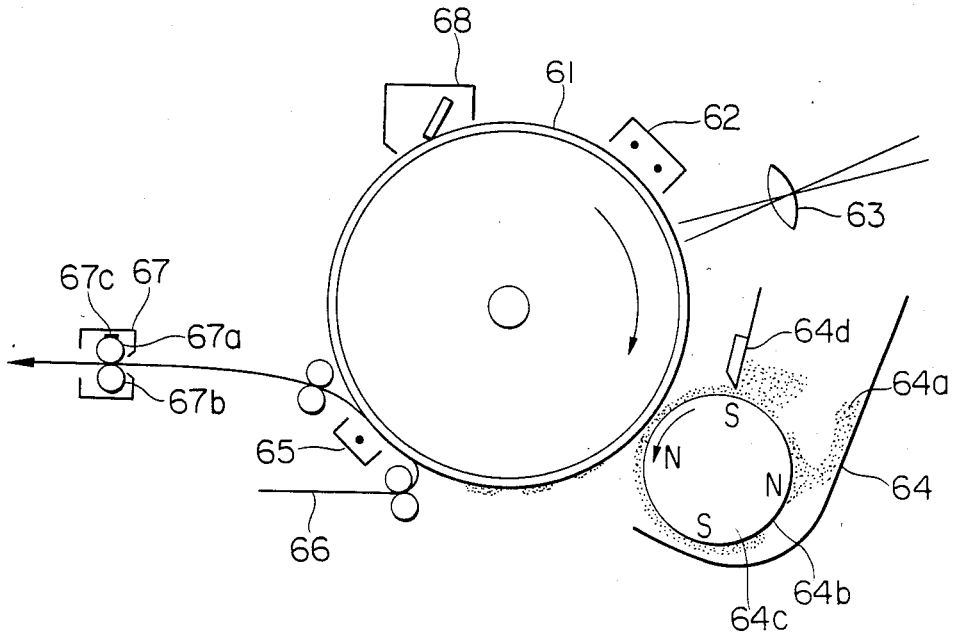
FIG. 6 illustrates an example of the toner image forming systems according to the invention.

FIG. 6 shows an embodiment of the image forming systems to which the toner of the invention is applicable.

Therein, 61 is an OPC photosensitive member, which comprises an OPC photosensitive and an earthed conductive substrate and rotates at a constant speed (herein, peripheral velocity 100 mm/sec) in the arrow direction; 62 is a well-known charging device, which discharges a negative polarity corona of −7 KV to impart negative charge onto the photosensitive member 61; 63 is an image irradiation device for projecting an original image, a light image, or a light beam modulated with image signals, thereby a negative latent image being formed on the photosensitive member. The formed negative image is developed by means of a development device 64. The toner **64*a* in the development device 64 is a positive-chargeable magnetic toner consisting of 100 parts of a styrene-butyl methacrylate copolymer, 10 parts of a polypropylene (melt viscosity at 140° C.: 280 cps), 2 parts of nigrosine dye, 60 parts of a magnetic powder, and 2 parts of colloidal silica. By rotating the development sleeve 64*b* made of stainless steel which contains fixed magnets 64*c*, in the arrow direction at a peripheral velocity nearly equal to that of the photosensitive member, the toner is passed through the gap, set to 250 μm, between an iron blade 64*d* and the sleeve 64*b* to form a coating layer on the sleeve 64*b*. The spread toner on the sleeve 64*b* is transferred to the photosensitive member 61 at the minimum space region between the photosensitive member 61 and the sleeve 64*b*, according to the pattern of the latent image on the photosensitive member 61. In this case, the gap between the sleeve 64*b* and the photosensitive member 61 is set to 250 μm, and a −150 V d.c. bias and a 1.5 KV a.c. 1.2 KHz bias are applied to the sleeve 64*b*. The formed toner image is transferred to a transfer paper 66, which is one kind of plain paper, by means of a charging device 65 which generates a discharge of −7 KV. The transferred image is fixed by means of a fixing device 67 which comprises a fixing roller 67*a* coated with polytetrafluoroethylene containing heat-source and a pressure roller 67*b* coated with silicone rubber. In the fixing device 67, 67*c*** is a cleaner impregnated with an oil.

The toner remaining on the photosensitive member 61 without being transferred to the paper is removed therefrom by means of a cleaner 68.

In this way, clear images were obtained. Further, a running test of making 20,000 copies showed that this toner formed good quality images up to the last copy, and that the amount of the offset toner adhering to the cleaner **67*c*** was very little. In this case, the pressure roller had positive charge.

COMPARATIVE EXAMPLE 21

A black fine powder prepared in the same manner as in Example 68 but using no silicone oil having an amine on its side chain. Then, 100 parts of this black fine powder was mixed with 0.4 part of the same fine powder of silica (specific surface area: 130 $m^2/g$, untreated) as used in Example 68, to make up a toner. In the same copying test as in Example 68, this toner formed poor images only.

COMPARATIVE EXAMPLE 22

A toner was prepared by mixing 100 parts of the black fine powder made in Comparative Example 21 with 0.4 part of a fine powder of silica (specific surface area 90 $m^2/g$, untreated) synthesized by a wet process. This toner formed good image in the initial stage of the same copying test as conducted in Example 68, but a considerable amount of the offset toner was observed in a running test of making 20,000 copies. The pressure roller was negatively charged.

COMPARATIVE EXAMPLE 23

A toner was prepared and tested in the same manner as in Example 68 but using a silicone oil consisting of polydimethylsiloxane in place of the silicone oil having an amine on its side chain, for the toner preparation. As a result, a considerable amount of the offset toner was observed. The pressure roller was negatively charged.

EXAMPLE 69

A toner was prepared and tested in the same manner as in Example 68 but using a different silicone oil (viscosity at 25° C.: 60 cps, amine equivalent: 360) having an amine on its side chain, for the toner preparation. This toner gave clear, fog-free images and little offset. Charge on the pressure was positive.

EXAMPLE 70

A blue fine powder of approximate particle sizes 5–20 μm was prepared in nearly the same manner as in Example 68 using 70 parts of a styrene-butyl methacrylate-dimethylaminoethyl methacrylatedivinylbenzene (weight ratio 70:25:5:0.6) copolymer (MI: 0.9g/10min at 110° C., 10 kg load), 30 parts of a styrene-butadiene (weight ratio 85:15) copolymer (MI. 0.4g/10min. at 110° C., 10 kg load), 7 parts of phthalocyanine blue, 4 parts of low molecular weight polypropylene, and 30 parts of a fine powder of silica (specific surface area: about 90 $m^2/g$) treated with 30 wt. % of a silicone oil (viscosity at 25° C., 3500 cps, amine equivalent: 3800) having an amine on its side chain.

Then, 12 parts of the above blue fine powder was mixed with 0.3 part of a treated fine powder of silica in the same manner as stated in the Example 68 and 88 parts of a carrier iron powder (tradename: EFV 250/400, made by Nihon Teppun Co., Ltd.) to make up a developer.

A negative electrostatic latent image formed on an OPC photosensitive member was developed with this developer, the resulting powder image was transferred onto a plain paper, and the transferred image was fixed by means of a pair of heat rolls (one being a fixing roll coated with fluororesin and the other a pressure roll coated with silicone rubber).

In this way, clear, fog-free images were obtained. Further, in a running test of making 20,000 copies, good quality images were also obtained with little offset.

EXAMPLES 71–74

Toners were prepared and tested in the same manner as in Example 68 but using different grades of silicone oil (viscosity at 25° C., amine equivalent, and amount used for treatment: 3500 cps, 2000, 50 wt. %; 20 cps, 320, 30 wt. %; 250 cps, 7600, 45 wt. %; 2300 cps, 3800, 40 wt. %) for the treatment of the fine powder of silica in the toner preparation. These toners also gave good quality images. The respective MI values were 2.9; 2.3; 2.8; and 2.5.

EXAMPLES 75–77

Toners were prepared and tested in nearly the same manner as in Example 68 but using the following fine powders treated with the same silicone oil having an amine on its side chain, respectively in place of the fine powder of silica treated with the same silicone oil.

| Fine Powders | Ex. 75 | Ex. 76 | Ex. 77 |
|---|---|---|---|
| Powder material | $TiO_2$ | $CaCO_3$ | $SiO_2$ |
| Amount of silicone oil used for treatment | 20 wt. % | 30 wt. % | 60 wt. % |
| Specific surface area of powder ($m^2/g$) | 10 | 18 | 300 |
| MI of toner (g/10 min. at 125° C., 10 kg load) | 3.9 | 3.2 | 1.8 |

These toners also gave good results.

What we claim is:

1. A developer containing a silicone oil which has an amine on side chain thereof.

2. The developer of claim 1, wherein said silicone oil is contained in an inorganic fine powder.

3. The developer of claim 2, wherein the inorganic fine powder is a fine powder of silica.

4. The developer of claim 1, wherein said silicone oil is contained in toner having an MI of 0.01–10 g/10 min.

5. The developer of claim 1, wherein said silicone oil has a constituent represented by the formula:

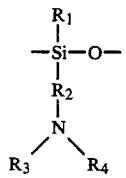

(I)

wherein $R_1$ represents hydrogen, alkyl, aryl or alkoxy; $R_2$ represents alkylene and/or phenylene; and $R_3$ and $R_4$ represent each hydrogen, alkyl or aryl; wherein the alkyl, aryl, alkylene and phenylene each may have an amine, if desired, a substituent such as halogen provided that the substituent does not impair the chargeability of the developer.

6. The developer of claim 2, wherein said silicone oil has a constituent represented by the formula

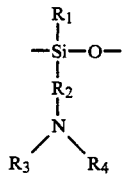

wherein $R_1$ represents hydrogen, alkyl, aryl or alkoxy; $R_2$ represents alkylene and/or phenylene; and $R_3$ and $R_4$ represent each hydrogen, alkyl or aryl; wherein the alkyls, aryls, alkylene and phenylene each may have an amine, and if desired, or a substituent such as halogen provided that the substituent does not impair the chargeability of the developer.

7. The developer of claim 3, wherein said silicone oil has a constituent represented by the formula

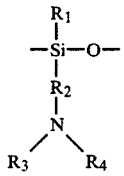

wherein $R_1$ represents hydrogen, alkyl, aryl or alkoxy; $R_2$ represents alkylene and/or phenylene; and $R_3$ and $R_4$ represent each hydrogen, alkyl or aryl; wherein the alkyls, aryls alkylene and phenylene each may have an amine and if desired, a substituent such as halogen provided that the substituent does not impair the chargeability of the developer.

8. The developer of claim 4, wherein said silicone oil has a constituent represented by the formula

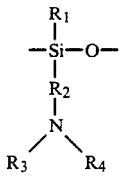

wherein $R_1$ represents hydrogen, alkyl, aryl or alkoxy; $R_2$ represents alkylene and/or phenylene; and $R_3$ and $R_4$ represent each hydrogen, alkyl or aryl; wherein the alkyls, aryls, alkylene and phenylene each may have an amine, and if desired, a substituent such as halogen provided that the substituent does not impair the chargeability of the toner.

9. The developer of claim 1, wherein said silicone oil is contained in a magnetic toner.

10. The developer of claim 9, wherein the magnetic toner comprises an inorganic fine powder treated with said silicone oil.

11. The developer of claim 10, wherein the inorganic fine powder is a fine powder of silica.

12. A development process which comprises arranging a member holding an electrostatic image on the surface and a member for carrying a toner on the surface to face each other with a definite gap being kept therebetween at a development section; applying a toner containing a silicone oil having an amine on side chain thereof to the toner-carrying member in the thickness less than said gap; and transferring the applied toner onto the electrostatic image holding member at the development section, thereby developing the image.

13. The development process of claim 12, wherein said toner comprises an inorganic fine powder treated with a silicone oil having an amine on side chain thereof.

14. The development process of claim 13, wherein said inorganic fine powder is a fine powder of silica.

15. The development process of claim 13, wherein said toner has an MI of 0.01–10 g/10 min.

16. The development process of claim 12, wherein said silicone oil has a constituent represented by the formula

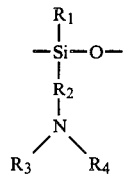

wherein $R_1$ represents hydrogen, alkyl, aryl or alkoxy; $R_2$ represents alkylene and/or phenylene; and $R_3$ and $R_4$ represent each hydrogen, alkyl or aryl; wherein the alkyls, aryls, alkylene and phnylene each may have an amine, and if desired, a substituent such as halogen provided that the substituent does not impair the chargeability of a toner.

17. A fixing method which comprises contacting a toner image on an image-supporting member with a heated roller, said toner image being formed of a toner which contains a silicone oil having an amine on side chain thereof and has an MI (melt index) of 0.01–10 g/10 min.

* * * * *

UNITED STATES PATENT AND TRADEMARK OFFICE

CERTIFICATE OF CORRECTION

PATENT NO. : 4,568,625

DATED : February 4, 1986

INVENTOR(S) : MASAKI UCHIYAMA, ET AL.

It is certified that error appears in the above-identified patent and that said Letters Patent is hereby corrected as shown below:

Column 2, line 3, "proceeses" should be --processes--.
Column 2, line 8, "no carrier" should be --no carrier.--.
Column 2, line 50, "generated the surface" should be --generated on the surface--.
Column 4, line 16-17, "disadvantage" should be --disadvantages--.
Column 4, line 54, "are partially" should be --is partially--.
Column 5, line 65, "easy to result" should be --readily results--.
Column 5, line 67, "difficult to result" should be --does not readily result--.
Column 6, line 5, "ressistance" should be --resistance--.
Column 8, line 54, "himidity" should be --humidity--.
Column 9, lines 14-15, "definete" should be --definite--.
Column 9, lines 52-53, "toner-carrying" should be --toner carrying member--.
Column 9, line 28, "posses" should be --possesses--.
Column 9, line 36, "too excess" should be --excessive--.
Column 9, line 37, "toner-carrying is" should be --toner carrying member is--.
Column 9, line 49, "has clearly influences" should be --has clear influences--.
Column 9, line 54, "importnat" should be --important--.
Column 9, line 59, "requisites characteristic" should be --requisite characteristics--.
Column 9, line 62, "have fulfilled" should be --have been fulfilled--.
Column 11, line 29, "Philadephia" should be --Philadelphia--.
Column 11, line 52, "visualize" should be --visualizes--.
Column 11, line 53, "studied about this phenomenon," should be --studied this phenomenon,--.
Column 12, line 23, "disperse" should be --disperses--.
Column 12, line 29, "blowed" should be --blown--

UNITED STATES PATENT AND TRADEMARK OFFICE

CERTIFICATE OF CORRECTION

PATENT NO. : 4,568,625

DATED : February 4, 1986

INVENTOR(S) : MASAKI UCHIYAMA, ET AL.

It is certified that error appears in the above-identified patent and that said Letters Patent is hereby corrected as shown below:

Column 12, line 38, "if" should be --is--.
Column 12, line 53, "aminoprophytrimethoxysilane" should be --aminopropyltrimethoxysilane--.
Column 13, line 37, "can selected" should be --can be selected--.
Column 14, lines 36-37, "megnitic" should be --magnetic--.
Column 14, line 37, "employed" should be --is employed--.
Column 15, line 13, "coated a resin" should be --coated with a resin--.
Column 15, lines 23-24, "a bias" should be --bias--.
Column 16, line 39, "with keep" should be --keeping--.
Column 19, line 67, "31 600" should be -- -600 --.
Column 27, lines 41-42, "methacrylatedime-thylamimoethyl" should be --methacrylate-diethylaminoethyl--.
Column 25, lines 5-6, "methacrylatedimethytaminoethyl" should be --methacrylate-dimethylaminoethyl--.
Column 25, line 40, "partsof" should be --parts of--.
Column 26, line 3, "wax" should be --was--.

UNITED STATES PATENT AND TRADEMARK OFFICE

CERTIFICATE OF CORRECTION

PATENT NO. : 4,568,625

DATED : February 4, 1986

INVENTOR(S) : MASAKI UCHIYAMA, ET AL.

It is certified that error appears in the above-identified patent and that said Letters Patent is hereby corrected as shown below:

Column 30, lines 54-55, "hundres-thousands" should be --hundreds to thousands--.

Column 31, lines 40-41, "methacrylatedvinylbenzene" should be --methacrylate-divinylbenzene--.

Column 33, line 23, "methacrylatedvinylbenzene" should be --methacrylate-divinylbenzene--.

Column 36, line 33, "phnylene" should be --phenylene--.

Signed and Sealed this

Thirtieth Day of December, 1986

*Attest:*

DONALD J. QUIGG

*Attesting Officer* *Commissioner of Patents and Trademarks*